US011766877B2

(12) United States Patent
Yoshinaga

(10) Patent No.: US 11,766,877 B2
(45) Date of Patent: Sep. 26, 2023

(54) CONVEYANCE DEVICE, LIQUID DISCHARGE APPARATUS, AND POST-PROCESSING APPARATUS

(71) Applicant: Hiroshi Yoshinaga, Chiba (JP)

(72) Inventor: Hiroshi Yoshinaga, Chiba (JP)

(73) Assignee: RICOH COMPANY, LTD., Tokyo (JP)

( * ) Notice: Subject to any disclaimer, the term of this patent is extended or adjusted under 35 U.S.C. 154(b) by 15 days.

(21) Appl. No.: 17/592,515

(22) Filed: Feb. 4, 2022

(65) Prior Publication Data

US 2022/0281234 A1 Sep. 8, 2022

(30) Foreign Application Priority Data

Mar. 4, 2021 (JP) ..... 2021-034377

(51) Int. Cl.
*B41J 11/00* (2006.01)
*B41J 29/377* (2006.01)

(52) U.S. Cl.
CPC ..... *B41J 11/0022* (2021.01); *B41J 29/377* (2013.01)

(58) Field of Classification Search
CPC ..... B41J 11/0022; B41J 29/377; B65H 2301/5143; B65H 2406/121; B65H 2406/122; B65H 2406/14; B65H 2801/06; B65H 5/062; B65H 7/00
See application file for complete search history.

(56) References Cited

U.S. PATENT DOCUMENTS

| | | | |
|---|---|---|---|
| 2012/0224878 | A1 | 9/2012 | Ikebuchi et al. |
| 2013/0183071 | A1 | 7/2013 | Iwaya et al. |
| 2013/0195493 | A1 | 8/2013 | Hase et al. |
| 2013/0266355 | A1 | 10/2013 | Yoshiura et al. |
| 2014/0369703 | A1 | 12/2014 | Hase et al. |
| 2015/0160591 | A1 | 6/2015 | Hase et al. |
| 2015/0212459 | A1 | 7/2015 | Hase et al. |
| 2016/0054691 | A1 | 2/2016 | Hase et al. |
| 2017/0176906 | A1 | 6/2017 | Sawada et al. |
| 2017/0185015 | A1 | 6/2017 | Yoshinaga et al. |
| 2017/0185021 | A1 | 6/2017 | Seki et al. |
| 2017/0285542 | A1 | 10/2017 | Hase et al. |
| 2018/0356754 | A1 | 12/2018 | Yoshinaga et al. |
| 2020/0341419 | A1 | 10/2020 | Shimada et al. |

FOREIGN PATENT DOCUMENTS

| | | |
|---|---|---|
| JP | 2011-230494 | 11/2011 |
| JP | 2015-230327 | 12/2015 |
| JP | 2019-064169 | 4/2019 |

*Primary Examiner* — Bradley W Thies
(74) *Attorney, Agent, or Firm* — XSENSUS LLP

(57) ABSTRACT

A conveyance device includes a conveyor that conveys a sheet. A ventilator sends air to the sheet conveyed by the conveyor in a predetermined region. A controller controls the ventilator to change an air capacity of the air at a time when a leading end of the sheet in a sheet conveyance direction is in the predetermined region and at a time when the leading end of the sheet is past the predetermined region.

18 Claims, 17 Drawing Sheets

CONVEYANCE DEVICE, LIQUID DISCHARGE APPARATUS, AND POST-PROCESSING APPARATUS

CROSS-REFERENCE TO RELATED APPLICATION

This patent application is based on and claims priority pursuant to 35 U.S.C. § 119(a) to Japanese Patent Application No. 2921-034377, filed on Mar. 4, 2021, in the Japan Patent Office, the entire disclosure of which is hereby incorporated by reference herein.

BACKGROUND

Technical Field

Exemplary aspects of the present disclosure relate to a conveyance device, a liquid discharge apparatus, and a post-processing apparatus, and more particularly, to a conveyance device, a liquid discharge apparatus incorporating the conveyance device, and a post-processing apparatus incorporating the conveyance device.

Discussion of the Background Art

Related-art image forming apparatuses, such as copiers, facsimile machines, printers, and multifunction peripherals (MCP) having two or more of copying, printing, scanning, facsimile, plotter, and other functions, typically form an image on a recording medium according to image data.

Such image forming apparatuses include an inkjet image forming apparatus that discharges liquid such as ink onto a sheet serving as a recording medium to form an image on the sheet.

SUMMARY

This specification describes below an improved conveyance device. In one embodiment, the conveyance device includes a conveyor that conveys a sheet. A ventilator sends air to the sheet conveyed by the conveyor in a predetermined region. A controller controls the ventilator to change an air capacity of the air at a time when a leading end of the sheet in a sheet conveyance direction is in the predetermined region and at a time when the leading end of the sheet is past the predetermined region.

This specification further describes an improved liquid discharge apparatus. In one embodiment, the liquid discharge apparatus includes a liquid discharger that discharges liquid onto a sheet and the conveyance device described above that conveys the sheet.

This specification further describes an improved post-processing apparatus. In one embodiment, the post-processing apparatus includes the conveyance device described above and a post-processing device that performs post-processing on the sheet conveyed from the conveyance device.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
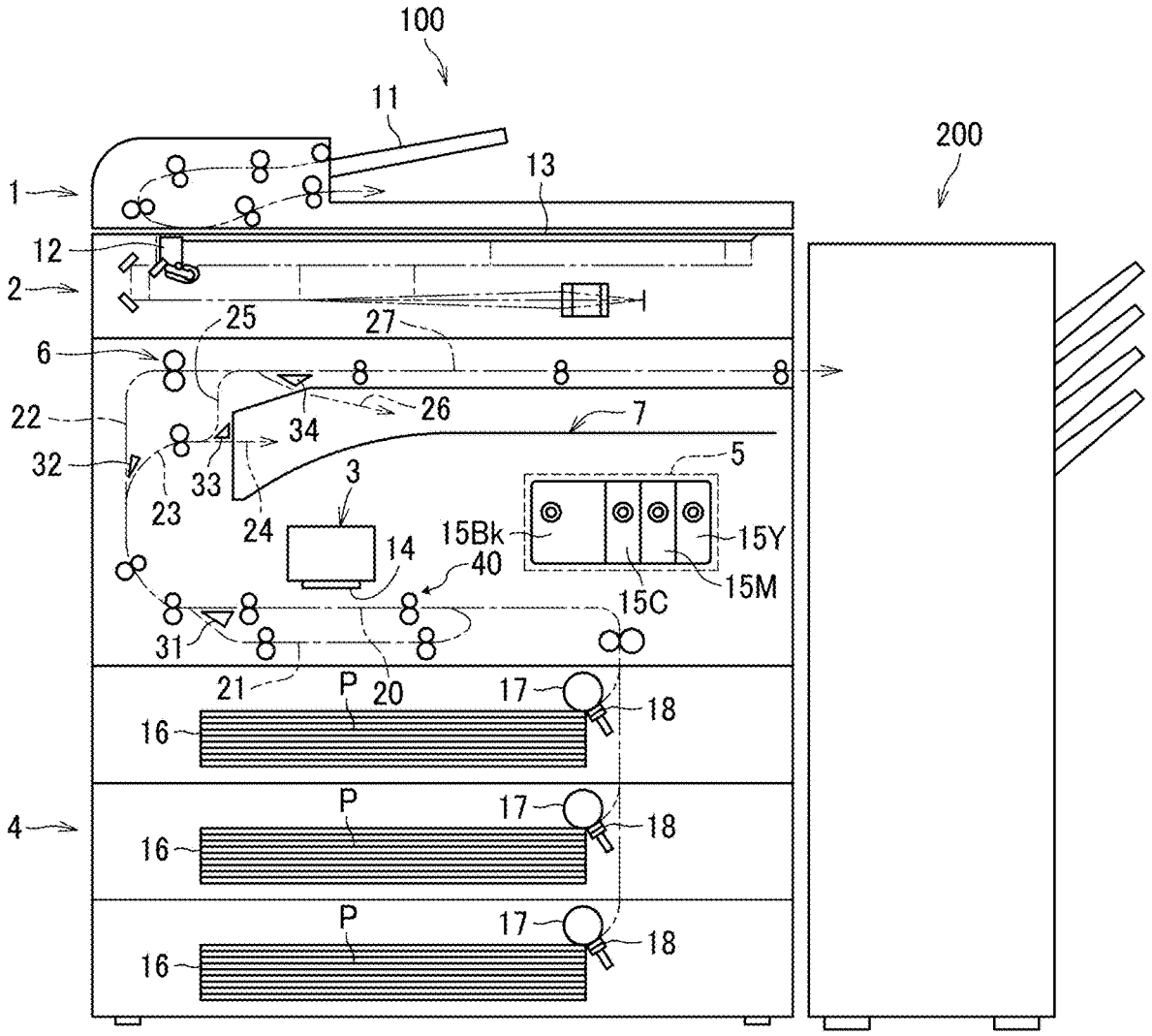
FIG. 1 is a schematic cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a". "an", and "the" are intended to include the plural forms as well, unless the context clearly indicates otherwise.

Referring to the attached drawings, the following describes embodiments of the present disclosure.

In the drawings for explaining the embodiments of the present disclosure, identical reference numerals are assigned to elements such as members and parts that have an identical function or an identical shape as long as differentiation is possible and a description of those elements is omitted once the description is provided.

FIG. 1 is a schematic cross-sectional view of an image forming apparatus 100 according to an embodiment of the present disclosure.

As illustrated in FIG. 1, the image forming apparatus 100 according to this embodiment, also serving as a liquid discharge apparatus, includes an original conveyance device 1, a scanner 2, an image forming device 3, a sheet supply 4, a cartridge holder 5, a dryer 6 (e.g., a heating portion), and a sheet ejection portion 7. A post-processing apparatus 200 (e.g., a finisher) is disposed beside the image forming apparatus 100.

The original conveyance device 1 separates an original from other originals placed on an original tray 11 and conveys the original to an exposure glass 13 of the scanner 2. The original conveyance device 1 includes a plurality of conveyance rollers serving as original conveyors that convey the original.

The scanner 2 reads an image on an original placed on the exposure glass 13 by a user or an image on the original that is conveyed from the original conveyance device 1 and passes over the exposure glass 13. The scanner 2 includes an optical scanning unit 12 serving as an image reading portion that reads the image on the original. The optical scanning unit 12 includes a light source and a charge-coupled device (CCD). The light source irradiates the original on the exposure glass 13 with light. The CCD serves as an image reader that reads the image on the original with reflected light reflected by the original. Alternatively, a contact image sensor (CIS) or the like may be used as the image reader.

The image forming device 3 includes a plurality of liquid discharge heads 14 serving as liquid dischargers that discharge liquid, for example, ink, onto a sheet P. The liquid discharge heads 14 may employ a serial type system in which the liquid discharge heads 14 discharge ink while the liquid discharge heads 14 move in a main scanning direction (e.g., a width direction of the sheet P). Alternatively, the liquid discharge heads 14 may employ a line type system in which the plurality of liquid discharge heads 14 stationarily arranged in the main scanning direction discharges ink.

The cartridge holder 5 is removably mounted with a plurality of ink cartridges 15Y, 15M, 15C, and 15Bk. The ink cartridges 15Y, 15M, 15C, and 15Bk are replenished with ink in different colors, for example, yellow, magenta, cyan, and black, respectively. Liquid feed pumps supply ink to the liquid discharge heads 14 from the ink cartridges 15Y, 15M, 15C, and 15Bk, respectively.

The sheet supply 4 includes a plurality of sheet trays 16 serving as sheet storages, respectively. Each of the sheet trays 16 loads, as a sheet P onto which an image is to be formed, cut paper cut into a sheet having a predetermined size in a sheet conveyance direction such as an A4 size and a B4 size in advance. Each of the sheet trays 16 is mounted with a feed roller 17 serving as a sheet feeder that feeds the sheet P and a separation pad 18 serving as a sheet separator that separates the sheet P from other sheets P.

The dryer 6 serves as a heating portion that heats the sheet P. The dryer 6 facilitates drying of ink on the sheet P under heat. The dryer 6 also serves as a conveyance device that includes a pair of rotators. As the pair of rotators rotates while sandwiching the sheet P, the pair of rotators conveys the sheet P.

The post-processing apparatus 200 performs post-processing such as alignment on the sheets P sent from the image forming apparatus 100. The post-processing apparatus 200 includes, as a post-processing portion, a sheet aligner that aligns and ejects the plurality of sheets P. Alternatively, the post-processing portion may be a punch that cuts holes in the sheet P, a stapler that staples the plurality of sheets P, a folder that folds the sheet P in half or in three, or the like.

Referring to FIG. 1, a description is provided of basic operations of the image forming apparatus 100 according to this embodiment.

When the image forming apparatus 100 receives an instruction to start a print job, a sheet P is fed from one of the plurality of sheet trays 16. For example, as the feed roller 17 rotates, the feed roller 17 and the separation pad 18 separate an uppermost sheet P from other sheets P (e.g., a sheaf of sheets P) placed in the sheet tray 16 and feed the uppermost sheet P.

When the sheet P is conveyed to a conveyance path 20 extended horizontally in FIG. 1 and disposed opposite the image forming device 3, the image forming device 3 forms an image on the sheet P. For example, as the liquid discharge heads 14 are controlled to discharge ink according to image data created by the scanner 2 that reads an image on an original or print data instructed by a terminal, the liquid discharge heads 14 discharge ink onto an image bearing face (e.g., an upper face) of the sheet P, thus forming an image on the sheet P. The image formed on the sheet P may be a meaningful image such as characters and drawings or a meaningless image such as patterns.

If the print job instructs duplex printing, the sheet P is conveyed in an opposite direction at a downstream position disposed downstream from the image forming device 3 in the sheet conveyance direction. Thus, the sheet P is guided to a reverse conveyance path 21. For example, after a trailing end of the sheet P passes a first path switch 31 disposed downstream from the image forming device 3 in the sheet conveyance direction, the first path switch 31 switches a conveyance path to the reverse conveyance path 21 through which the sheet P is conveyed in the opposite direction, Thus, the first path switch 31 guides the sheet P to the reverse conveyance path 21. The sheet P passes through the reverse conveyance path 21 and is conveyed to the image forming device 3 again in a state in which the sheet P is reversed. The image forming device 3 performs image formation as described above, forming an image on a back side of the sheet P.

A second path switch 32 is disposed downstream from the first path switch 31 in the sheet conveyance direction. The second path switch 32 selectively guides the sheet P bearing the image to a conveyance path 22 provided with the dryer 6 or a conveyance path 23 not provided with the dryer 6. If the second path switch 32 guides the sheet P to the conveyance path 22 provided with the dryer 6, the dryer 6 facilitates drying of ink on the sheet P. Conversely, if the second path switch 32 guides the sheet P to the conveyance path 23 not provided with the dryer 6, a third path switch 33 selectively guides the sheet P to a conveyance path 24 directed to the sheet ejection portion 7 or a conveyance path 25 directed to the post-processing apparatus 200. A fourth path switch 34 selectively guides the sheet P that is past the dryer 6 to a conveyance path 26 directed to the sheet ejection portion 7 or a conveyance path 27 directed to the post-processing apparatus 200.

If the sheet P is guided to the conveyance path 24 or 26 directed to the sheet ejection portion 7, the sheet P is ejected onto the sheet ejection portion 7. Conversely, if the sheet P is guided to the conveyance path 25 or 27 directed to the post-processing apparatus 200, the sheet P is conveyed to the post-processing apparatus 200 where the sheet P is treated with predetermined post-processing and ejected. Thus, a series of printing processes is completed. The image forming apparatus 100 according to this embodiment employs a face-down manner ejection system in which the sheet P is ejected onto the sheet ejection portion 7 or sent to the post-processing apparatus 200 in a state in which the image bearing face of the sheet P faces down. The image bearing face is adhered with ink when an image is formed on one side (e.g., a front side) of the sheet R Alternatively, the image forming apparatus 100 may employ a face-up manner ejection system in which the sheet P is ejected onto the sheet ejection portion 7 or sent to the post-processing apparatus 200 in a state in which the image bearing face of the sheet P faces up.

The image forming apparatus 100 according to this embodiment includes a conveyance device 40 including a plurality of conveyance roller pairs that conveys the sheet P supplied from the sheet supply 4.

Figure 2:
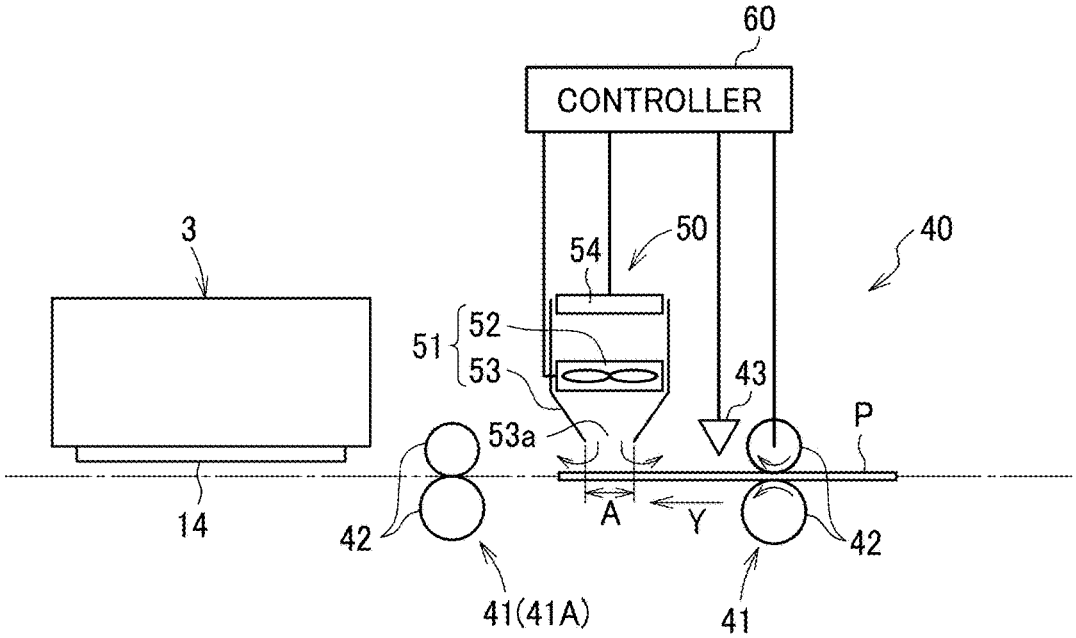
FIG. 2 is a cross-sectional view of a conveyance device according to a first embodiment of the present disclosure, that is incorporated in the image forming apparatus depicted in FIG. 1.

FIG. 2 is a diagram of the conveyance device 40, illustrating a construction thereof. The conveyance device 40 is disposed upstream from the image forming device 3 in a sheet conveyance direction Y in which the sheet P is conveyed.

Referring to FIG. 2, the following describes the construction of the conveyance device 40 according to a first embodiment of the present disclosure.

As illustrated in FIG. 2, the conveyance device 40 according to this embodiment includes a plurality of conveyance roller pairs 41 serving as conveyors that convey the sheet P. Each of the conveyance roller pairs 41 includes two conveyance rollers 42 that contact each other. As the conveyance rollers 42 rotate, the conveyance rollers 42 convey the sheet P in the sheet conveyance direction Y. Among the conveyance roller pairs 41, a conveyance roller pair 41A is disposed immediately upstream from the image forming device 3 in the sheet conveyance direction Y. The conveyance roller pair 41A serves as a correction roller pair that corrects skew of the sheet P. For example, as the sheet P comes into contact with a nip formed between the two conveyance rollers 42 of the conveyance roller pair 41A serving as the correction roller pair while the conveyance roller pair 41A does not rotate and is still, the conveyance roller pair 41A halts the sheet P temporarily and corrects skew of the sheet P. Thereafter, the conveyance roller pair 41A serving as the correction roller pair resumes rotation and conveys the sheet P to the image forming device 3. A guide that guides the sheet P is interposed between the conveyance roller pairs 41. However, the guide is omitted in FIG. 2 for simplification.

As illustrated in FIG. 2, the conveyance device 40 according to this embodiment includes a ventilation device 50 disposed upstream from the conveyance roller pair 41A serving as the correction roller pair in the sheet conveyance direction Y The ventilation device 50 includes a ventilator 51 and a heater 54 serving as a heat source. For example, the ventilator 51 includes a fan 52 serving as an airflow generator and a duct 53 serving as an air channel former. The duct 53 is disposed opposite the sheet P such that the duct 53 blows air against the sheet P in a direction perpendicular to or substantially perpendicular to the sheet P. The heater 54 is a sheathed heater (e.g., a nichrome wire heater), a ceramic heater, a halogen heater, a graphite heater, a carbon heater, or the like. According to this embodiment, the heater 54 is disposed upstream from the fan 52 in an airflow direction. Alternatively, the heater 54 may be disposed downstream from the fan 52 in the airflow direction. The heater 54 may be combined with the fan 52.

In the ventilation device 50 according to this embodiment, when the heater 54 starts generating heat and the fan 52 starts rotating, the heater 54 warms air into warm air that blows out from the duct 53 through a vent 53*a* (e.g., an outlet). When the sheet P enters a predetermined region, that is, a blow region A, disposed opposite the vent 53*a*, the warm air blows against the sheet P. Thus, the warm air warms the sheet P before an image is formed on the sheet P. Thereafter, as the sheet P reaches the image forming device 3, the image forming device 3 discharges ink onto the sheet P, thus forming an image on the sheet P. The sheet P warmed by the ventilation device 50 facilitates drying of ink on the sheet P under heat, thus suppressing smearing of ink or degradation of the image on the sheet P. If volatile ink is used, since the sheet P is warmed in advance, the volatile ink volatilizes and dries quickly.

When the sheet P enters the blow region A of the ventilation device 50, as the ventilation device 50 sends air (e.g., warm air) to the sheet P, the air blown against the sheet P may turn up a leading end of the sheet P in the sheet conveyance direction Y or may flutter the sheet P. Accordingly, the sheet P may not enter the nip formed between the two conveyance rollers 42 of the conveyance roller pair 41A serving as the correction roller pair and may be jammed. Even if the sheet P is not jammed, the sheet P may not be conveyed smoothly, causing conveyance failure.

A description is provided of a construction of a comparative inkjet image forming apparatus.

The comparative inkjet image forming apparatus includes a blower that blows warm air against a sheet or ink on the sheet. While a table placed with the sheet moves, the blower blows the warm air against the sheet or the ink on the sheet, facilitating drying of the ink on the sheet.

However, with a configuration described above in which the blower blows the warm air against the sheet while the table placed with the sheet moves, the warm air blown against the sheet may turn up a leading end of the sheet in a moving direction of the table or may flutter the sheet, causing faulty conveyance of the sheet.

In order to suppress faulty conveyance of the sheet P caused by warm air blown against the sheet P, the conveyance device 40 according to this embodiment controls blowing by the ventilation device 50.

Figure 3:
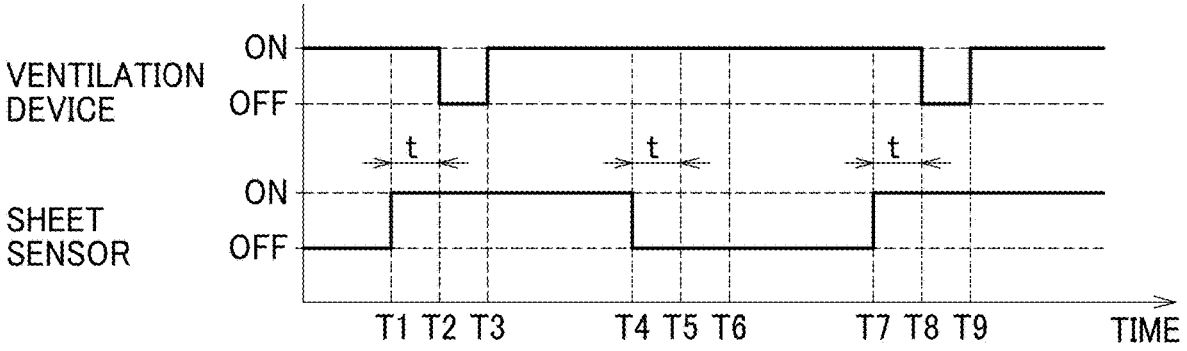
FIG. 3 is a timing chart of blowing according to the first embodiment by a ventilation device incorporated in the conveyance device depicted in FIG. 2.
Figure 4:
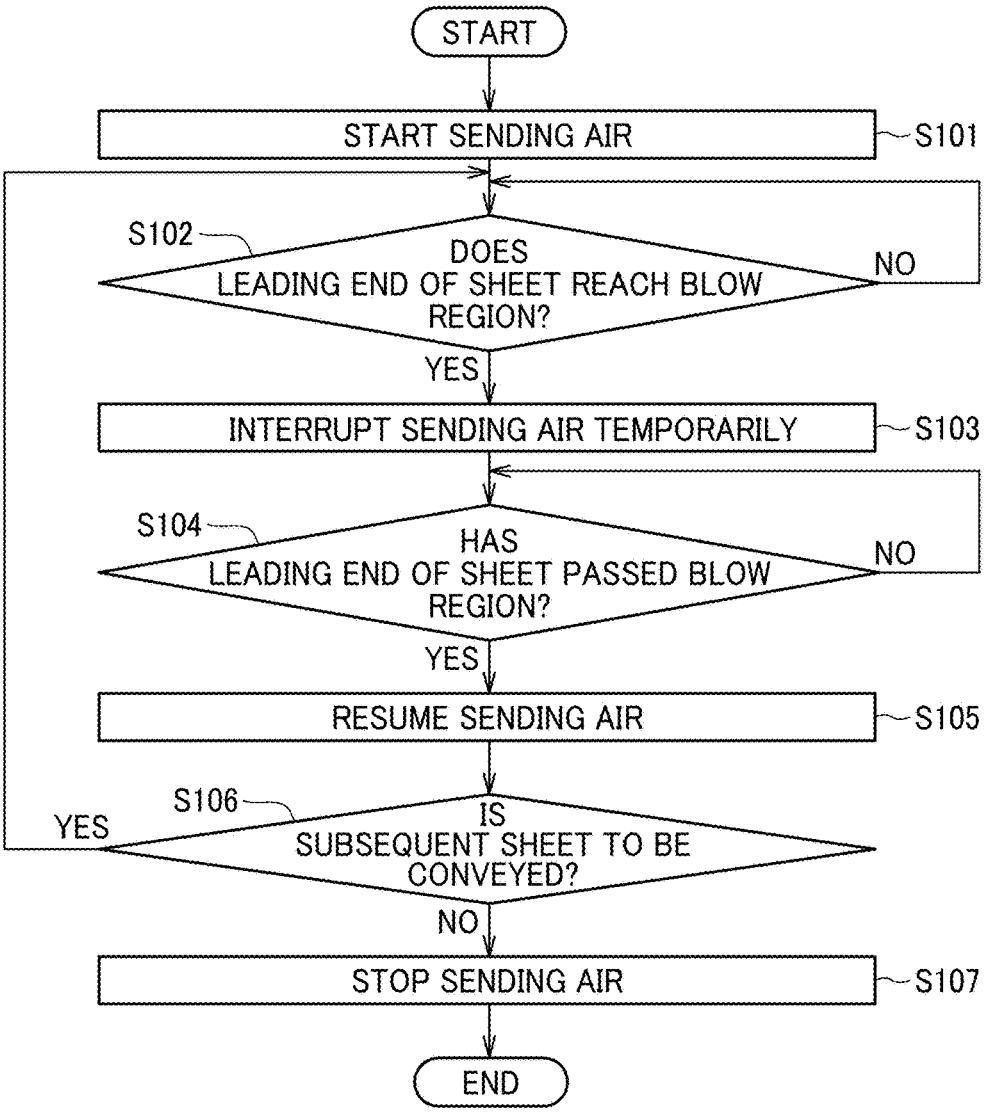
FIG. 4 is a flowchart of blowing according to the first embodiment by the ventilation device incorporated in the conveyance device depicted in FIG. 2.

Referring to FIGS. 3 and 4, the following describes blowing by the ventilation device 50 according to the first embodiment of the present disclosure.

FIG. 3 is a timing chart of blowing by the ventilation device 50 according to the first embodiment of the present disclosure. FIG. 4 is a flowchart of blowing by the ventilation device 50 according to the first embodiment.

According to this embodiment, when the image forming apparatus 100 depicted in FIG. 1 receives an image formation request, the feed roller 17 feeds a sheet P from the sheet tray 16. Accordingly, as illustrated in FIG. 4, the ventilation device 50 starts sending air at a predetermined time in step S101. Thereafter, a sheet sensor 43 illustrated in FIG. 2 detects the sheet P. The sheet sensor 43 serves as a sheet detector that is disposed upstream from the ventilation device 50 in the sheet conveyance direction Y.

As illustrated in FIG. 3, a time T1 denotes a time when the sheet sensor 43 detects the leading end of the sheet P When a predetermined time t elapses from the time T1 when the sheet sensor 43 detects the leading end of the sheet P, the leading end of the sheet P reaches the blow region A. In order to prevent the leading end of the sheet P from being affected by air sent from the ventilation device 50, according to this embodiment, when the predetermined time t elapses from the time T1 when the sheet sensor 43 detects the leading end of the sheet P, that is, at a time T2 when a controller 60 depicted in FIG. 2 determines that the leading end of the sheet P reaches the blow region A (YES in step S102 in FIG. 4), the controller 60 controls the ventilation device 50 to interrupt sending air temporarily in step S103 in FIG. 4.

While the leading end of the sheet P passes through the blow region A (e.g., during a time period from the time T2 to a time T3 in FIG. 3), the controller 60 controls the ventilation device 50 to continue interruption of blowing. Thereafter, at the time T3 when the controller 60 determines that the leading end of the sheet P has passed the blow region A (YES in step S104 in FIG. 4), the controller 60 controls the ventilation device 50 to resume sending air in step S105 in FIG. 4. The controller 60 determines the time T3 when the leading end of the sheet P has passed the blow region A based on a conveyance time or the like of the sheet P, that elapses from the time T1 when the sheet sensor 43 detects the leading end of the sheet P.

After the ventilation device 50 resumes sending air, the controller 60 controls the ventilation device 50 to continue sending air until a time T8 when a leading end of a subsequent sheet P reaches the blow region A. For example, if the controller 60 determines that the subsequent sheet P is to be conveyed (YES in step S106 in FIG. 4), at the time T8 when the controller 60 determines that the leading end of the subsequent sheet P reaches the blow region A, the controller 60 controls the ventilation device 50 to interrupt sending air temporarily. Until the controller 60 determines that no subsequent sheet P is to be conveyed, the controller 60 repeats control processes described above (e.g., steps S102 to S105). If the controller 60 determines that no subsequent sheet P is to be conveyed (NO in step S106 in FIG. 4), the controller 60 controls the ventilation device 50 to stop sending air in step S107 in FIG. 4, finishing image formation.

As illustrated in FIG. 3, a time T4 denotes a time when the sheet sensor 43 detects the trailing end of the sheet P in the sheet conveyance direction Y A time T5 denotes a time when the trailing end of the sheet P reaches the blow region A. A time T6 denotes a time when the trailing end of the sheet P has passed the blow region A. A time T7 denotes a time when the sheet sensor 43 detects the leading end of the subsequent sheet P. A time T9 denotes a time when the leading end of the subsequent sheet P has passed the blow region A.

As described above, according to this embodiment, after the leading end of the sheet P reaches the blow region A and before the leading end of the sheet P is past the blow region A, the ventilation device 50 interrupts sending air to the sheet P temporarily, preventing the air from turning up the leading end of the sheet P and fluttering the sheet P. Hence, according to this embodiment, the sheet P enters the nip formed between the conveyance rollers 42 of the conveyance roller pair 41A serving as the correction roller pair readily, improving conveyance of the sheet P.

After the leading end of the sheet P is past the blow region A, until the leading end of the subsequent sheet P reaches the blow region A, that is, during a time period from the time T3 to the time T8 depicted in FIG. 3, the ventilation device 50 continues sending air. Accordingly, warm air blown out from the ventilation device 50 warms the sheet P effectively. For example, according to this embodiment, also after the trailing end of the sheet P passes the blow region A (e.g., after the time T6 depicted in FIG. 3), the ventilation device 50 continues sending air. Accordingly, warm air blown out from the ventilation device 50 warms the conveyance path 20 depicted in FIG. 1 and a periphery thereof, warming the subsequent sheet P effectively and facilitating drying of ink on the subsequent sheet P.

A description is provided of embodiments that are different from the first embodiment described above.

Hereinafter, the embodiments are described mainly of configurations that are different from those of the first embodiment described above. A description of other configurations that are basically common to the first embodiment described above is omitted properly, FIG. 5 is a timing chart of blowing by the ventilation device 50 according to a second embodiment of the present disclosure. FIG. 6 is a flowchart of blowing by the ventilation device 50 according to the second embodiment.

Figure 5:
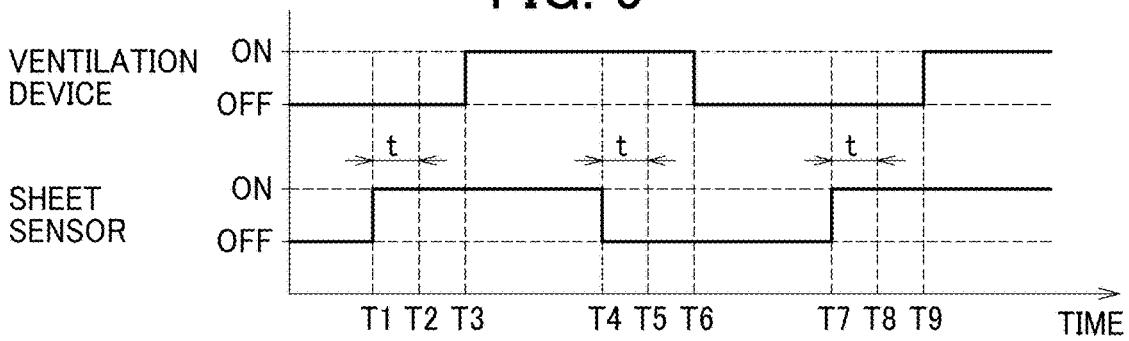
FIG. 5 is a timing chart of blowing according to a second embodiment of the present disclosure by the ventilation device incorporated in the conveyance device depicted in FIG. 2.
Figure 6:
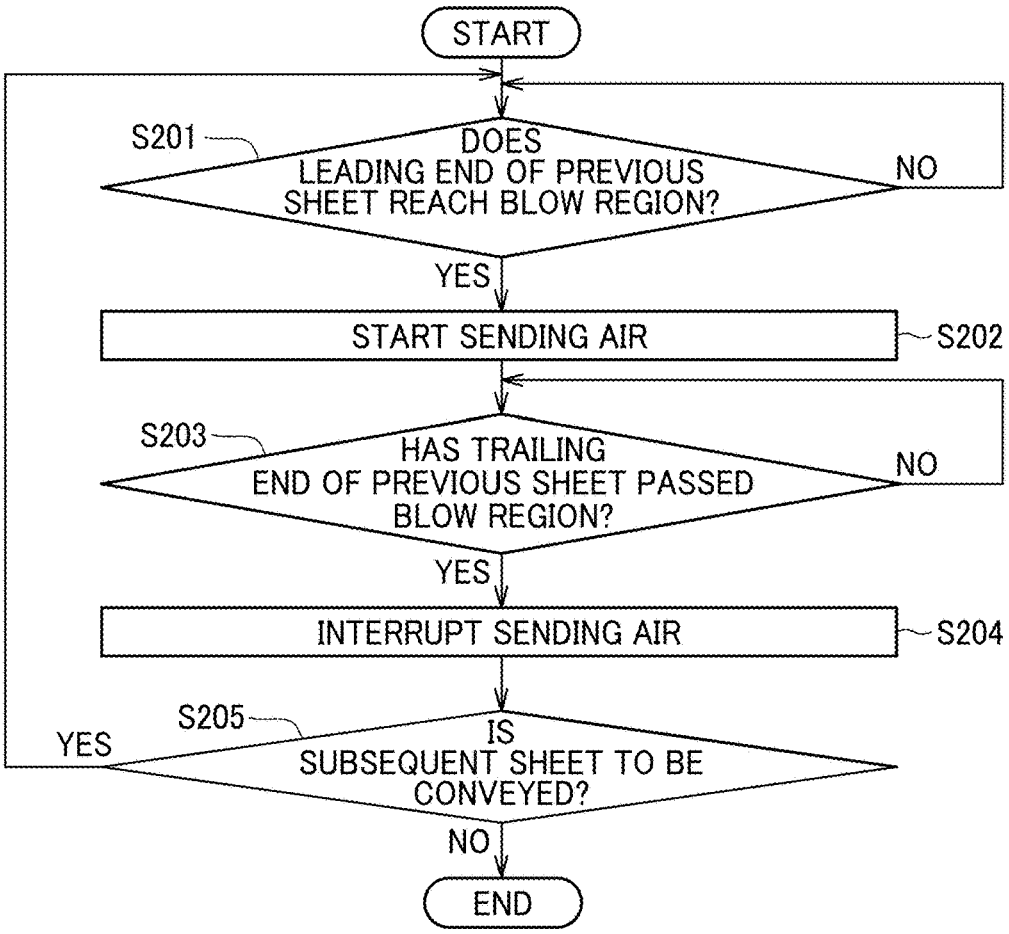
FIG. 6 is a flowchart of blowing according to the second embodiment by the ventilation device incorporated in the conveyance device depicted in FIG. 2.

As illustrated in FIG. 5, according to the second embodiment of the present disclosure, during a time period after the image forming apparatus 100 depicted in FIG. 1 receives an image formation request until the time T3 when a leading end of a previous sheet P (e.g., a first sheet P) is past the blow region A, and during a time period after the time T6 when a trailing end of the previous sheet P is past the blow region A until the time T9 when a leading end of a subsequent sheet P (e.g., a second sheet P) is past the blow region A, the controller 60 controls the ventilation device 50 to interrupt sending air. For example, according to this embodiment, solely during a time period from the time T3 when the leading end of the sheet P reaches the blow region A until the time T6 when the trailing end of the sheet P is past the blow region A, the controller 60 controls the ventilation device 50 to send air in steps S201 to S204 in FIG. 6.

For example, in step S201, the controller 60 determines whether or not the leading end of the previous sheet P reaches the blow region A. If the controller 60 determines that the leading end of the previous sheet P reaches the blow region A (YES in step S201), the controller 60 controls the ventilation device 50 to start sending air in step S202. In step S203, the controller 60 determines whether or not the trailing end of the previous sheet P has passed the blow region A. If the controller 60 determines that the trailing end of the previous sheet P has passed the blow region A (YES in step S203), the controller 60 controls the ventilation device 50 to interrupt sending air in step S204. In step S205, the controller 60 determines whether or not the subsequent sheet P is to be conveyed. If the controller 60 determines that the subsequent sheet P is to be conveyed (YES in step S205), the controller 60 controls the ventilation device 50 to blow air similarly.

As described above, according to this embodiment, solely while the sheet P passes through the blow region A, the controller 60 controls the ventilation device 50 to send air, reducing power consumption for sending air. While the controller 60 controls the ventilation device 50 to interrupt sending air, the controller 60 may control the heater 54 to interrupt heat generation. In this case, the conveyance device 40 reduces power consumption further.

Figure 7:
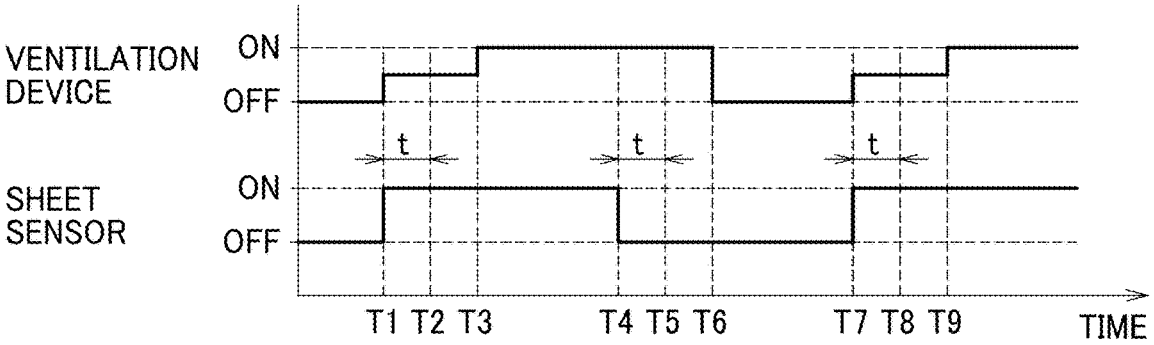
FIG. 7 is a timing chart of blowing according to a third embodiment of the present disclosure by the ventilation device incorporated in the conveyance device depicted in FIG. 2.
Figure 8:
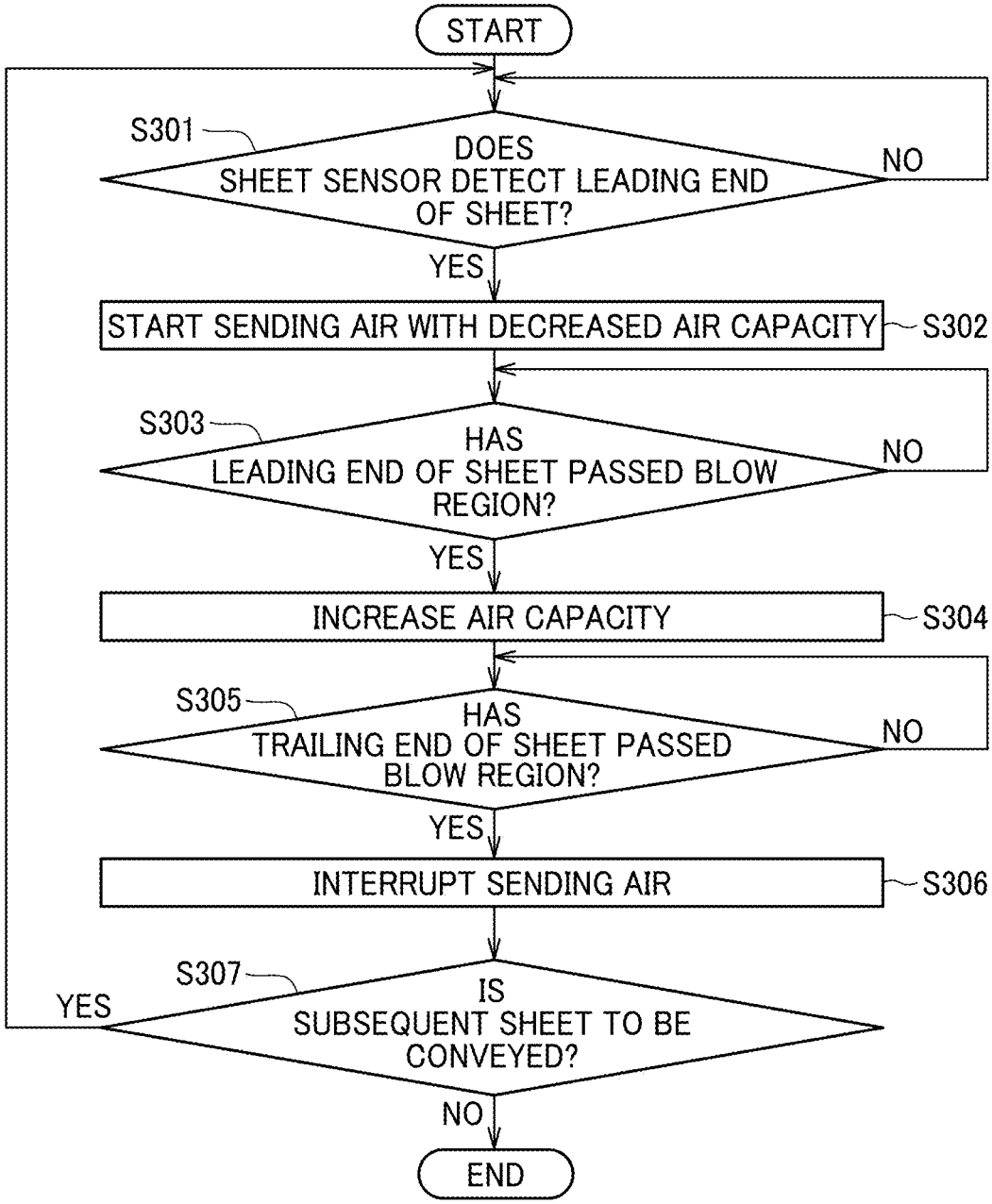
FIG. 8 is a flowchart of blowing according to the third embodiment by the ventilation device incorporated in the conveyance device depicted in FIG. 2.

FIG. 7 is a timing chart of blowing by the ventilation device 50 according to a third embodiment of the present disclosure. FIG. 8 is a flowchart of blowing by the ventilation device 50 according to the third embodiment.

As illustrated in FIG. 7, according to the third embodiment of the present disclosure, during a time period from the time T1 when the sheet sensor 43 detects the leading end of the sheet P until the time T3 when the leading end of the sheet P is past the blow region A, the controller 60 controls the ventilation device 50 to send air with a decreased air capacity (e.g., a weak wind force or a slow wind velocity) that is small enough to prevent the leading end of the sheet P from turning up in steps S301 and S302 in FIG. 8. For example, in step S301, the controller 60 determines whether or not the sheet sensor 43 detects the leading end of the sheet P. If the controller 60 determines that the sheet sensor 43 detects the leading end of the sheet P (YES in step S301), the controller 60 controls the ventilation device 50 to start sending air with the decreased air capacity in step S302. In step S303, the controller 60 determines whether or not the leading end of the sheet P has passed the blow region A at the time T3. If the controller 60 determines that the leading end of the sheet P has passed the blow region A at the time T3 (YES in step S303), the controller 60 increases the air capacity of the ventilation device 50 in step S304. For example, the controller 60 increases the wind force or the wind velocity of the ventilation device 50. In step S305, the controller 60 determines whether or not the trailing end of the sheet P has passed the blow region A at the time T6. If the controller 60 determines that the trailing end of the sheet P has passed the blow region A at the time T6 (YES in step S305), the controller 60 controls the ventilation device 50 to interrupt sending air in step S306. In step S307, the controller 60 determines whether or not the subsequent sheet P is to be conveyed. If the controller 60 determines that the subsequent sheet P is to be conveyed (YES in step S307), the controller 60 repeats steps S301 to S306 similarly.

According to this embodiment, the controller 60 controls the ventilation device 50 to decrease the wind capacity while the leading end of the sheet P passes through the blow region A, thus preventing air from turning up or fluttering the sheet P. The controller 60 changes the wind force of the ventilation device 50 by changing the rotation speed of the fan 52, the outlet area of the vent 53*a* of the duct 53, or the like. According to this embodiment, the ventilation device 50 starts sending air at the time T1 depicted in FIG. 7 when the sheet sensor 43 detects the leading end of the sheet P. Alternatively, the ventilation device 50 may start sending air at the time T2 when the controller 60 determines that the leading end of the sheet P reaches the blow region A.

Figure 9:
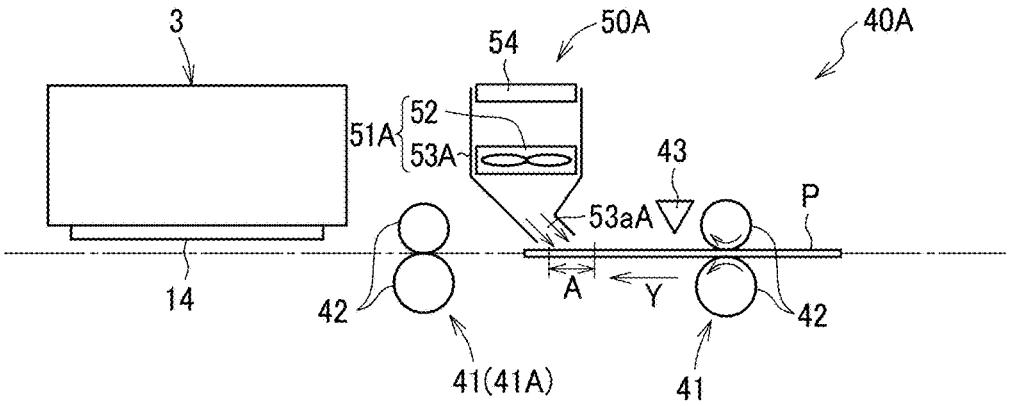
FIG. 9 is a cross-sectional view of a conveyance device according to a fourth embodiment of the present disclosure, that is installable in the image forming apparatus depicted in FIG. 1.

FIG. 9 is a diagram of a conveyance device 40A according to a fourth embodiment of the present disclosure, illustrating a construction of the conveyance device 40A.

As illustrated in FIG. 9, the conveyance device 40A according to the fourth embodiment of the present disclosure includes a ventilation device 50A including a ventilator 51A. The ventilator 51A includes a duct 53A that is bent such that a vent 53*a*A (e.g., an outlet) is extended diagonally with respect to the sheet P. Thus, the vent 53*a*A discharges air in an airflow direction that is diagonal to the sheet P and is directed upstream in the sheet conveyance direction Y The vent 53*a*A discharges warm air in the airflow direction that separates from the image forming device 3, preventing the warm air from increasing the temperature of the image forming device 3. According to this embodiment, the image forming device 3 does not suffer from temperature increase, suppressing increase in viscosity of ink, faulty discharging of ink, and the like. Thus, the image forming device 3 retains proper performance.

Figure 10:
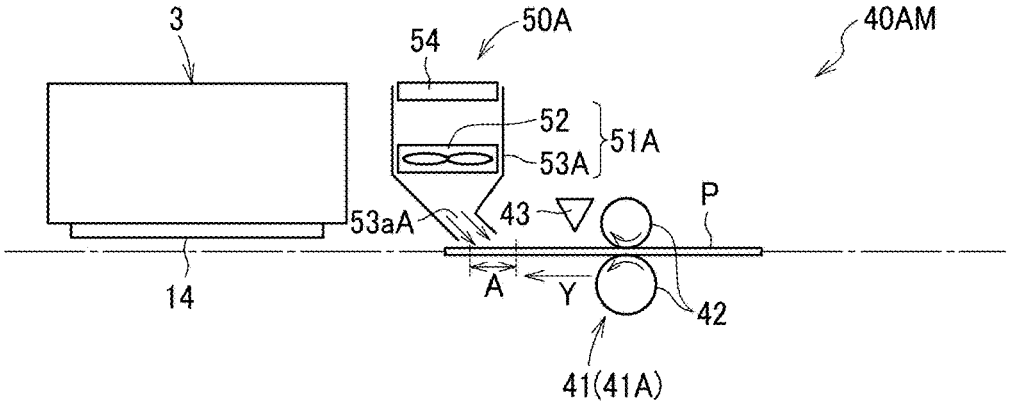
FIG. 10 is a cross-sectional view of a conveyance device as a modification example of the conveyance device depicted in FIG. 9.

The duct 53A including the vent 53*a*A according to this embodiment is preferably installed in a conveyance device 40AM configured as illustrated in FIG. 10. In the conveyance device 40AM configured as illustrated in FIG. 10, the ventilation device 50A is interposed between the image forming device 3 and the conveyance roller pair 41A serving as the correction roller pair. For example, the conversance roller pair 41A serving as the correction roller pair is not interposed between the ventilation device 50A and the image forming device 3. Hence, an airflow flown from the ventilation device 50A tends to move to the image forming device 3. Accordingly, if the ventilation device 50A sends air in an airflow direction that is perpendicular to or substantially perpendicular to the sheet P, the air (e.g., warm air) sent from the ventilation device 50A may move to the image forming device 3 and may adversely affect an ink discharge direction in which the liquid discharge heads 14 discharge ink. To address this circumstance, the ventilation device 50A according to this embodiment sends air in the airflow direction directed upstream in the sheet conveyance direction Y, preventing the air from moving to or entering the liquid discharge heads 14. Accordingly, the airflow from the ventilation device 50A does not adversely affect the ink discharge direction in which the liquid discharge heads 14 discharge ink, preventing degradation in quality of an image formed on the sheet P.

The controller 60 controls blowing according to any one of the embodiments described above. As the controller 60 employs any one of the embodiments described above, the controller 60 also controls the ventilation device 50A according to the fourth embodiment, preventing air sent from the ventilation device 50A from turning up or fluttering the sheet P. The controller 60 employs any one of the embodiments described above similarly also with embodiments described below.

Figure 11:
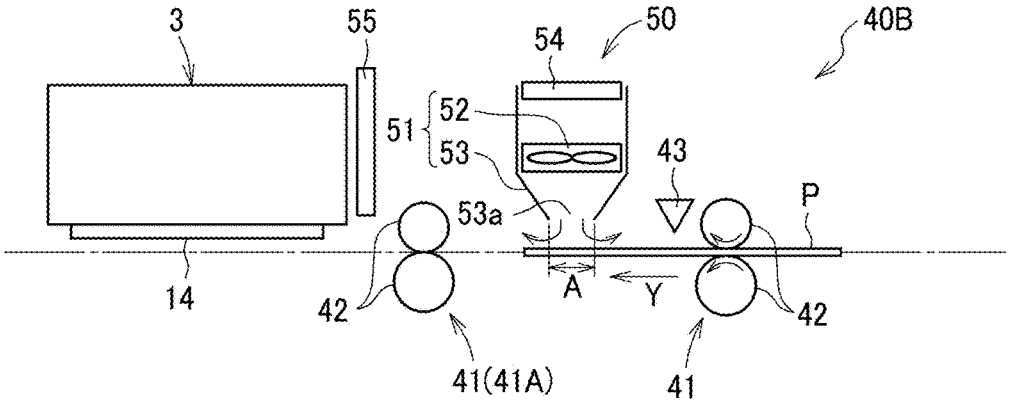
FIG. 11 is a cross-sectional view of a conveyance device according to a fifth embodiment of the present disclosure, that is installable in the image forming apparatus depicted in FIG. 1.

FIG. 11 is a diagram of a conveyance device 40B according to a fifth embodiment of the present disclosure, illustrating a construction of the conveyance device 40B.

As illustrated in FIG. 11, the conveyance device 40B according to the fifth embodiment of the present disclosure includes the duct 53 that sends air in the airflow direction that is not diagonal to the sheet conveyance direction Y or the sheet P but is perpendicular to or substantially perpendicular to the sheet conveyance direction Y or the sheet P, like the duct 53 according to the first embodiment described above with reference to FIG. 2. Accordingly, a part of warm air blown against the sheet, P may be reflected by the sheet P and moved toward the image forming device 3. To address this circumstance, according to this embodiment, as illustrated in FIG. 11, a thermal insulator 55 is interposed between the ventilation device 50 and the image forming device 3. For example, the thermal insulator 55 is disposed at a downstream position disposed downstream from the ventilator 51 in the sheet conveyance direction Y. The thermal insulator 55 is made of a thermal insulation material such as silicone sponge and urethane foam.

As described above, according to this embodiment, the thermal insulator 55 is interposed between the ventilation device 50 and the image forming device 3, preventing warm air blown out from the ventilation device 50 from increasing the temperature of the image forming device 3. Thus, according to this embodiment, the image forming device 3 does not suffer from temperature increase, suppressing increase in viscosity of ink, faulty discharging of ink, and the like. Thus, the image forming device 3 retains proper performance. The construction of the conveyance device 40B according to this embodiment may also be applied to other embodiments of the present disclosure.

Figure 12:
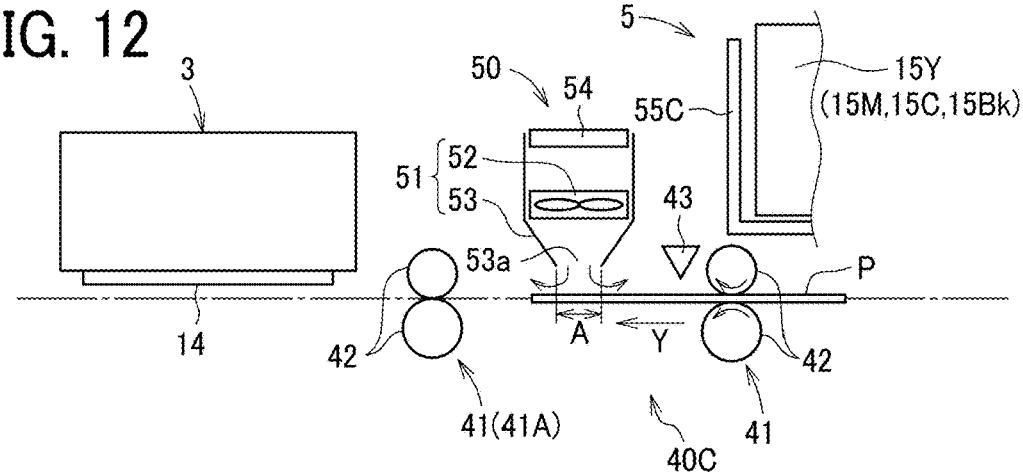
FIG. 12 is a cross-sectional view of a conveyance device according to a sixth embodiment of the present disclosure; that is installable in the image forming apparatus depicted in FIG. 1.

FIG. 12 is a diagram of a conveyance device 40C according to a sixth embodiment of the present disclosure, illustrating a construction of the conveyance device 40C.

As illustrated in FIG. 12, the conveyance device 40C according to the sixth embodiment of the present disclosure includes a thermal insulator 55C interposed between the ventilation device 50 and the cartridge holder 5. The cartridge holder 5 is disposed upstream from the ventilation device 50 in the sheet conveyance direction Y For example, the thermal insulator 55C is disposed at an upstream position disposed upstream from the ventilator 51 in the sheet conveyance direction Y The thermal insulator 55C is made of the thermal insulation material described above.

As described above, according to this embodiment, the thermal insulator 55C is interposed between the ventilation device 50 and the cartridge holder 5, preventing warm air blown out from the ventilation device 50 from increasing the temperature of the cartridge holder 5. Accordingly, the ink cartridges 15Y, 15M, 15C, and 15Bk mounted on the cartridge holder 5 do not suffer from temperature increase, suppressing increase in viscosity of ink, clogging of ink, and the like. The construction of the conveyance device 40C according to this embodiment may also be applied to other embodiments of the present disclosure.

Figure 13:
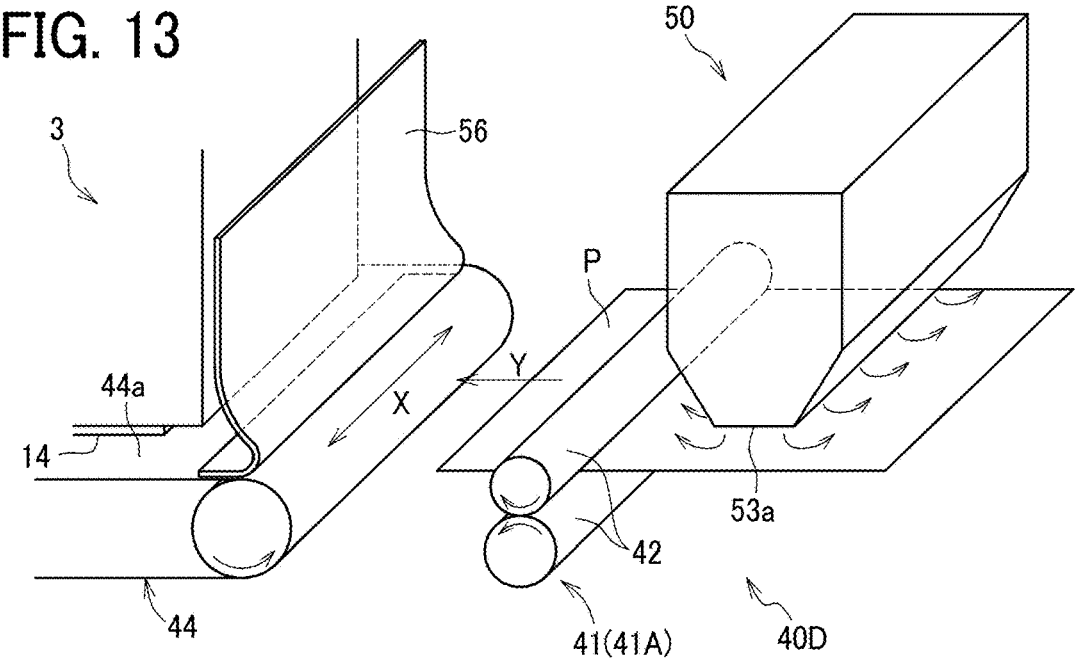
FIG. 13 is a perspective view of a conveyance device according to a seventh embodiment of the present disclosure, that is installable in the image forming apparatus depicted in FIG. 1.

FIG. 13 is a diagram of a conveyance device 40D according to a seventh embodiment of the present disclosure, illustrating a construction of the conveyance device 401).

As illustrated in FIG. 13, the conveyance device 40D according to the seventh embodiment of the present disclosure includes a wall 56 interposed between the ventilation device 50 and the image forming device 3. The wall 56 prevents air (e.g., warm air) blown out from the ventilation device 50 from moving toward the image forming device 3. The wall 56 is a soft, thin sheet such as Mylar®.

As illustrated in FIG. 13, the wall 56 extends continuously throughout an entire span of a conveyance belt 44 in an axial direction thereof or a width direction X of the sheet P, which is perpendicular to the sheet conveyance direction Y. The wall 56 contacts a conveyance face 44*a* of the conveyance belt 44 serving as a conveyor that is disposed opposite the liquid discharge heads 14. The conveyance belt 44 bears the sheet P on the conveyance face 44*a* and conveys the sheet P. The wall 56 separates an ink discharge clearance interposed between the liquid discharge heads 14 and the conveyance belt 44 from a ventilation chamber where the ventilation device 50 is situated.

According to this embodiment, even if air (e.g., warm air) blown out from the ventilation device 50 flows to the image forming device 3, the wall 56 prevents the air from entering the ink discharge clearance. Accordingly, the wall 56 reduces adverse effects caused by an airflow from the ventilation device 50 and inflicted on the ink discharge direction in which the liquid discharge heads 14 discharge ink.

Figure 14:
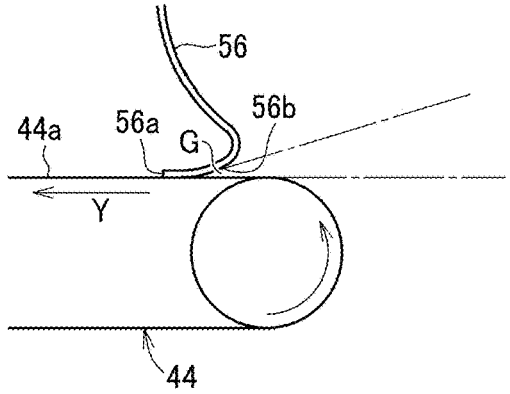
FIG. 14 is an enlarged cross-sectional view of a wall, a conveyance belt, and a periphery thereof incorporated in the conveyance device depicted in FIG. 13.

According to this embodiment, as the sheet P enters a nip formed between the conveyance belt 44 that rotates and the wall 56, the conveyance belt 44 conveys the sheet P. Since the conveyance belt 44 rotates, the conveyance face 44*a* of the conveyance belt 44 slides over the wall 56. To address this circumstance, as illustrated in FIG. 14, the wall 56 includes a contact portion that contacts the conveyance face 44*a* of the conveyance belt 44 and includes a tip 56*a*. The contact portion of the wall 56 is oriented in the sheet conveyance direction Y, that is, a rotation direction of the conveyance belt 44. Accordingly, even if the conveyance belt 44 rotates, the tip 56*a* of the wall 56 is not turned up. Additionally, according to this embodiment, the wall 56 includes a slope 56*h* that defines a gap G between the wall 56 and the conveyance face 44*a* of the conveyance belt 44. The gap G increases gradually from a contact position where the wall 56 contacts the conveyance face 44*a* of the conveyance belt 44 to an upstream position on the wall 56, which is disposed upstream from the contact position in the sheet conveyance direction Y. Hence, as the conveyance roller pair 41 conveys the sheet P to the conveyance belt 44, the wall 56 guides the leading end of the sheet P along the slope 56*b*. Thus, the sheet P enters the nip formed between the wall 56 and the conveyance face 44*a* of the conveyance belt 44 smoothly.

Figure 15:
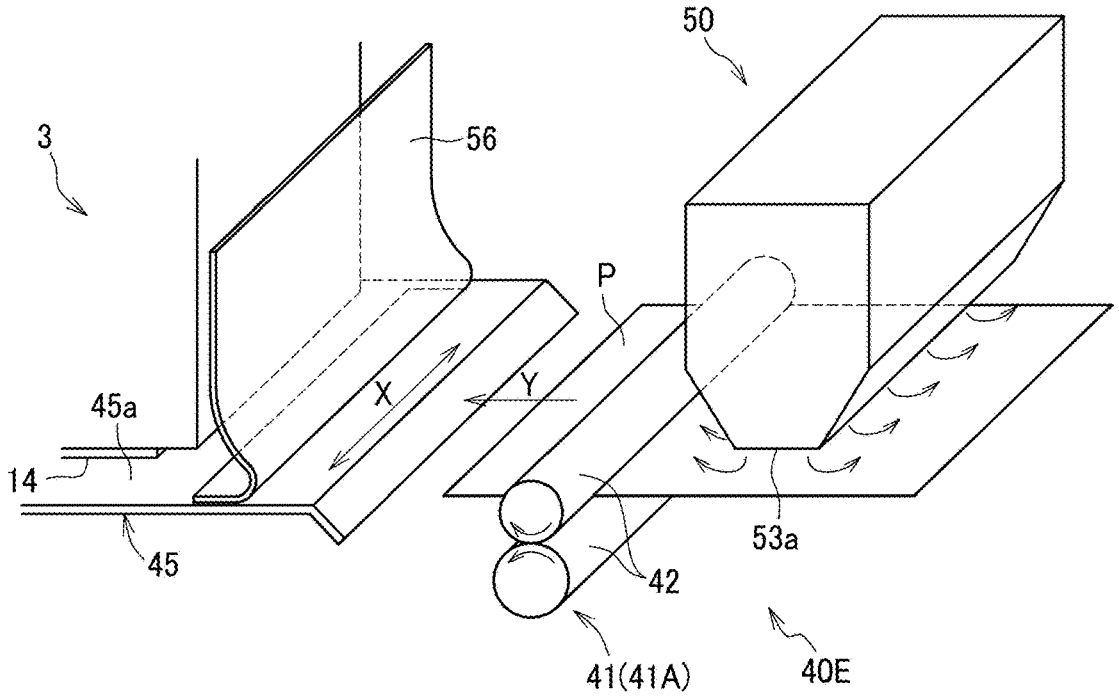
FIG. 15 is a perspective view of a conveyance device as a modification example of the conveyance device depicted in FIG. 13.

FIGS. 13 and 14 illustrate the wall 56 that contacts the conveyance belt 44. Alternatively, as illustrated in FIG. 15, a conveyance device 44E may include a guide 45 that contacts the wall 56. The guide 45 includes a guide face 45*a* that contacts and guides the sheet P. The wall 56 contacts the guide face 45*a* throughout an entire span of the guide 45 in the width direction X of the sheet P. Thus, the wall 56 prevents air blown out from the ventilation device 50 from entering an ink discharge clearance between the liquid discharge heads 14 and the guide 45. A shape and a material of the wall 56 depicted in FIG. 15 are equivalent to a shape and a material of the wall 56 depicted in FIGS. 13 and 14.

Figure 16:
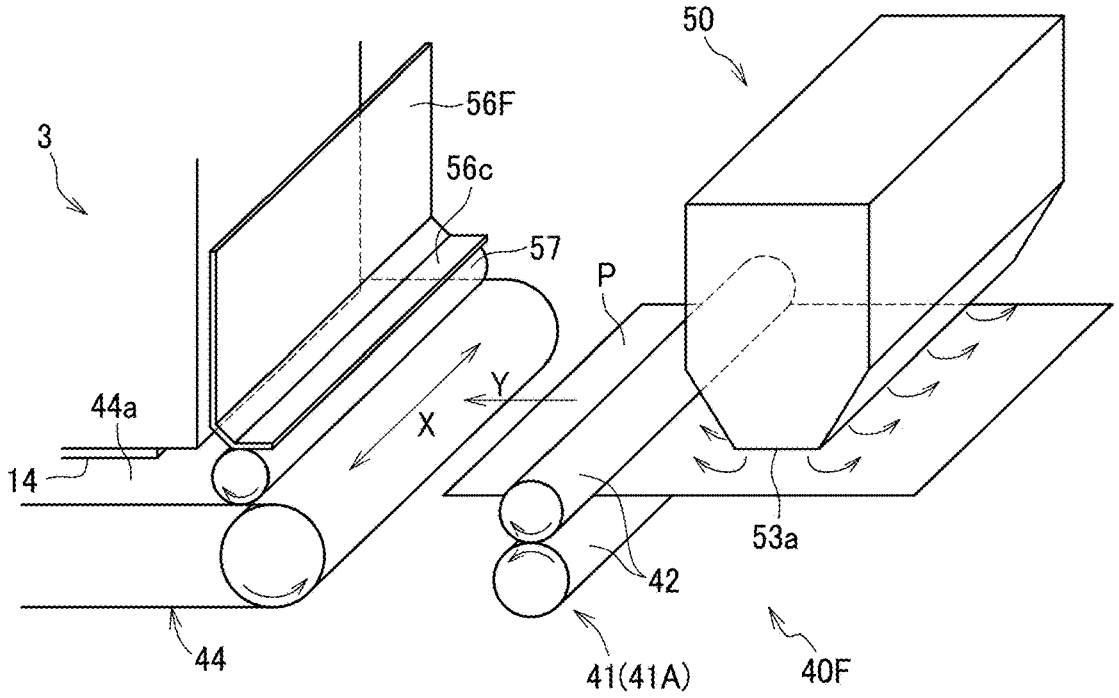
FIG. 16 is a perspective view of a conveyance device according to an eighth embodiment of the present disclosure, that is installable in the image forming apparatus depicted in FIG. 1.

FIG. 16 is a diagram of a conveyance device 40F according to an eighth embodiment of the present disclosure, illustrating a construction of the conveyance device 40F.

As illustrated in FIG. 16, the conveyance device 40F according to the eighth embodiment of the present disclosure includes a roller 57 interposed between a wall 56F and the conveyance belt 44. The roller 57 serves as a rotator and is cylindrical. The wall 56F includes a bent portion 56*c* disposed at a lower end of the wall 56F in FIG. 16. The lower end is bent into the bent portion 56*c* that extends horizontally in FIG. 16. A lower face of the bent portion 56*c* contacts an outer circumferential surface of the roller 57. The roller 57 extends in the width direction X of the sheet P. The roller 57 contacts both the bent portion 56*c* of the wall 56F and the conveyance face 44*a* of the conveyance belt 44 continuously throughout the entire span of the conveyance belt 44 in the width direction X of the sheet P.

As described above, according to this embodiment, the roller 57 and the wall 56F separate the ink discharge clearance interposed between the liquid discharge heads 14 and the conveyance belt 44 from the ventilation chamber where the ventilation device 50 is situated. Hence, according to this embodiment also, the roller 57 and the wall 56F prevent air (e.g., warm air) blown out from the ventilation device 50 from entering the ink discharge clearance, reducing adverse effects caused by an airflow from the ventilation device 50 and inflicted on the ink discharge direction in which the liquid discharge heads 14 discharge ink.

The sheet P conveyed from an upstream position upstream from the roller 57 in the sheet conveyance direction Y enters a nip formed between the conveyance belt 44 and the roller 57. The sheet P is conveyed by the conveyance belt 44 that rotates and the roller 57 that rotates in accordance with rotation of the conveyance belt 44. Thus, according to this embodiment, the sheet P does not rub the wall 56F. Accordingly, the roller 57 prevents generation of sliding friction with respect to the sheet P and conveys the sheet P smoothly.

Like the wall 56 described above with reference to FIG. 13, the wall 56F is a soft, thin sheet such as Mylar®. A material and a shape of the roller 57 are not limited unless the material and the shape disturb conveyance of the sheet P and are selected properly. For example, the roller 57 is made of foam rubber such as silicone sponge or other thermal insulation material, suppressing temperature decrease of the sheet P when the sheet P contacts the roller 57. For example, the roller 57 made of a thermal insulation material suppresses drawing of heat from the sheet P when the sheet P contacts the roller 57. Accordingly, the roller 57 conveys the sheet P to the image forming device 3 in a state in which the sheet P stores heat properly. Thereafter, ink on the sheet P dries effectively.

In order to suppress temperature decrease of the sheet P when the sheet P contacts the roller 57 or when the sheet P contacts the wall 56 depicted in FIGS. 13 to 15, the ventilation device 50 may send warm air to warm up the roller 57 or the wall 56 in advance. For example, while the image forming apparatus 100 is warmed up immediately after the image forming apparatus 100 is powered on, the roller 57 or the wall 56 does not store heat. Hence, after the image forming apparatus 100 is powered on, before conveyance of a first sheet P starts after the image forming apparatus 100 receives an image formation request, the ventilation device 50 may start sending air. Alternatively, after a previous image formation finishes, the image forming apparatus 100 may receive a subsequent image formation request after an interval. In this case also, the ventilation device 50 may continue sending air for a predetermined time period to warm up the roller 57 or the wall 56. Accordingly, the roller 57 or the wall 56 suppresses temperature decrease of the sheet P when the sheet P contacts the roller 57 or the wall 56. Thereafter, ink on the sheet P dries effectively.

Figure 17:
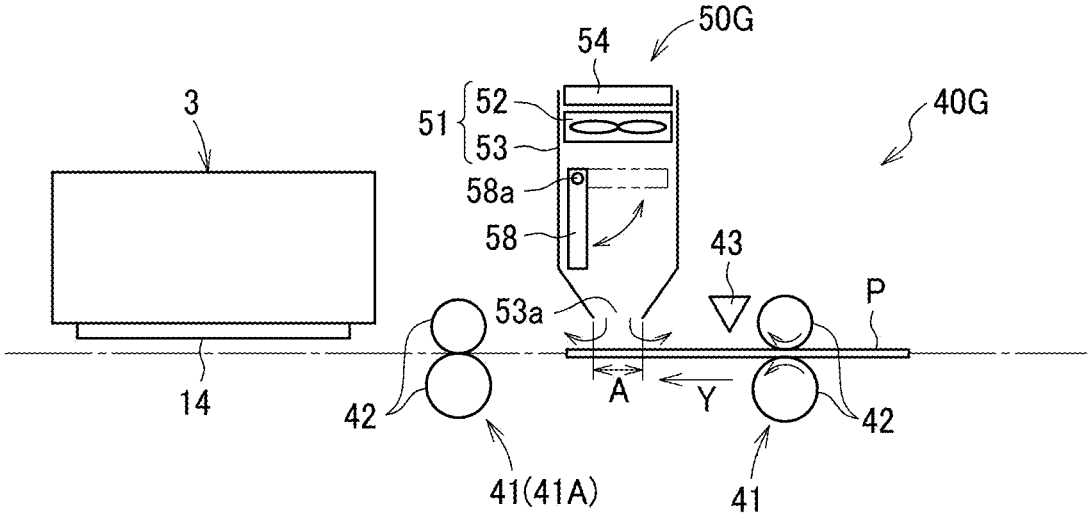
FIG. 17 is a cross-sectional view of a conveyance device according to a ninth embodiment of the present disclosure, that is installable in the image forming apparatus depicted in FIG. 1.

FIG. 17 is a diagram of a conveyance device 40G according to a ninth embodiment of the present disclosure, illustrating a construction of the conveyance device 40G.

As illustrated in FIG. 17, the conveyance device 40G according to the ninth embodiment of the present disclosure includes a ventilation device 50G including a valve 58 that opens and closes an air channel inside the duct 53. The valve 58 is pivotable about a shaft 58*a* disposed inside the duct 53. As the valve 58 pivots, the valve 58 opens and closes the air channel inside the duct 53. For example, when the valve 58 is disposed at an open position indicated with a solid line in FIG. 17, the air channel opens. When the valve 58 is disposed at a closed position indicated with an alternate long and two short dashes line in FIG. 17, the air channel closes.

Figure 18:
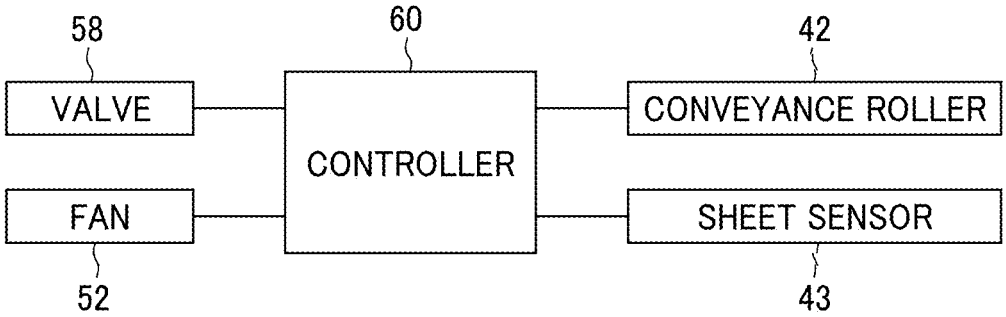
FIG. 18 is a block diagram of a controller that controls the conveyance device depicted in FIG. 17.

FIG. 18 illustrates the controller 60 that controls the valve 58 to open and close the air channel. In addition to the valve 58 that opens and closes the air channel, the controller 60 also controls (e.g., drives and rotates) the fan 52 to send air and controls (e.g., drives and rotates) the conveyance rollers 42 to convey the sheet P. Additionally, the controller 60 receives a detection signal from the sheet sensor 43 and controls the valve 58, the fan 52, and the conveyance rollers 42 based on the received detection signal.

As described above, according to this embodiment, as the valve 58 opens and closes the air channel inside the duct 53, the ventilation device 50G interrupts and resumes sending air. Hence, according to this embodiment, as the controller 60 controls the valve 58 to open and close the air channel based on the detection signal sent from the sheet sensor 43, the ventilation device 50G interrupts sending air while the leading end of the sheet P passes through the blow region A, thus preventing air from turning up or fluttering the sheet P. Alternatively, the valve 58 may slide and move in a horizontal direction or the like in FIG. 17 to open and close the air channel.

Figure 19:
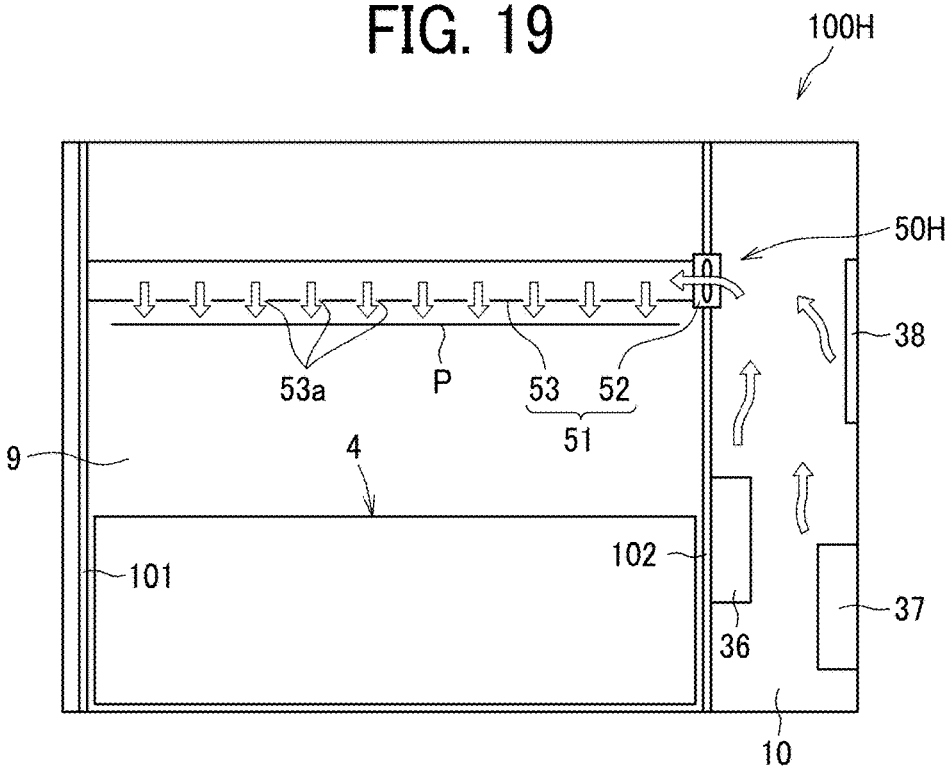
FIG. 19 is a cross-sectional view of an image forming apparatus according to a tenth embodiment of the present disclosure.

FIG. 19 is a diagram of an image forming apparatus 100I-1 according to a tenth embodiment of the present disclosure, also serving as a liquid discharge apparatus, illustrating a construction of the image forming apparatus 100H. FIG. 19 is a cross-sectional view of the image forming apparatus 100H, illustrating a ventilation device 50H seen from an upstream position disposed upstream from the ventilation device 50H in the sheet conveyance direction Y. A left side in FIG. 19 is a front face (e.g., a from) of the image forming apparatus 100H. A right side in FIG. 19 is a rear face (e.g., a rear) of the image forming apparatus 100H.

As illustrated in FIG. 19, according to the tenth embodiment of the present disclosure, the ventilation device 50H does not incorporate the heater 54 depicted in FIG. 2. The ventilation device 50H uses heat generated by a driver 36, a power supply 37, and an electrical component 38 disposed inside the image forming apparatus 100H. The driver 36 drives the image forming device 3, the conveyance rollers 42, and the like. The power supply 37 supplies power to various elements inside the image forming apparatus 100H. The power supply 37 supplies power to electronic components of the electrical component 38 that controls operations of various elements inside the image forming apparatus 100H. Accordingly, the driver 36, the power supply 37, and the electrical component 38 generate heat. The fan 52 supplies air (e.g., warm air) warmed by heat generated by the driver 36, the power supply 37, and the electrical component 38 into the duct 53. The warm air is sent to a sheet P not formed with an image yet through the vent 53*a* of the duct 53. In FIG. 19, the fan 52 is disposed at an upstream end of the duct 53 in an airflow direction. Alternatively, the fan 52 may be disposed in a partway of the air channel inside the duct 53. Yet alternatively, the fan 52 may be disposed at a downstream portion of the duct 53 in the airflow direction at a position in proximity to the vent 53*a*.

As described above, according to this embodiment, in order to warm the sheet P before an image is formed on the sheet P, instead of heat generated by a heat source such as a heater, the ventilation device 50H uses heat generated by the driver 36, the power supply 37, and the electrical component 38, reducing power consumption for warming the sheet P. For example, heat generated by heat radiators such as the driver 36, the power supply 37, and the electrical component 38 that radiate heat regardless of primary objectives and functions thereof is used effectively as heat (e.g., warm air) that warms the sheet P, thus reducing power consumption for supplying heat and costs. Additionally, like this embodiment, if the ventilation device 50H does not use an exclusive heater for drying the sheet P, the ventilation device 50H reduces manufacturing costs of the image forming apparatus 100H and simplifies the construction of the image forming apparatus 100H, improving reliability of the image forming apparatus 100H.

The image forming apparatus 100H according to this embodiment further includes a rear chamber 10 accommodating the driver 36, the power supply 37, and the electrical component 38 and a front chamber 9 accommodating the image forming device 3 and the like. Since the rear chamber 10 is separated from the front chamber 9, dry air (e.g., warm air) inside the rear chamber 10 is sent to the sheet P. For example, according to this embodiment, the image forming apparatus 100H accommodates a front frame 101 and a rear frame 102 serving as supports that support the image forming device 3, the duct 53, and the like. The image forming device 3, the sheet supply 4, the duct 53, and the like are disposed in the front chamber 9 disposed frontward from the rear frame 102. The driver 36, the power supply 37, and the electrical component 38 are disposed in the rear chamber 10 disposed rearward from the rear frame 102.

In the rear chamber 10 configured as described above, no ink is discharged and no sheet P adhered with ink is conveyed. Hence, the rear chamber 10 contains less moisture that generates as ink on the sheet P evaporates than the front chamber 9. Accordingly, the rear chamber 10 supplies air (e.g., warm air) containing less moisture to the sheet P. Thus, the warm air reduces moisture on the sheet P while warming the sheet P, facilitating drying of ink adhered to the sheet P effectively.

Figure 20:
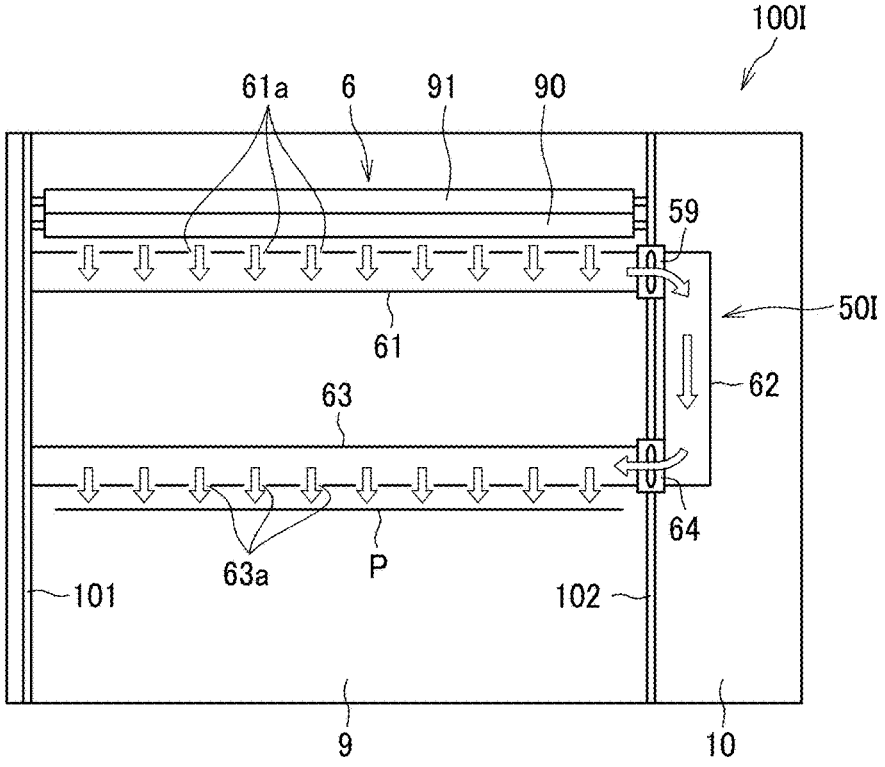
FIG. 20 is a cross-sectional view of an image forming apparatus according to an eleventh embodiment of the present disclosure.

FIG. 20 is a diagram of an image forming apparatus 100I according to an eleventh embodiment of the present disclosure, illustrating a construction of the image forming apparatus 100I.

As illustrated in FIG. 20, the image forming apparatus 100I according to the eleventh embodiment of the present disclosure, also serving as a liquid discharge apparatus, includes a ventilation device 50I that uses heat generated by the dryer 6 (e.g., a heating portion). Hence, the ventilation device 50I according to this embodiment also does not incorporate an exclusive heater (e.g., the heater 54).

Figure 21:
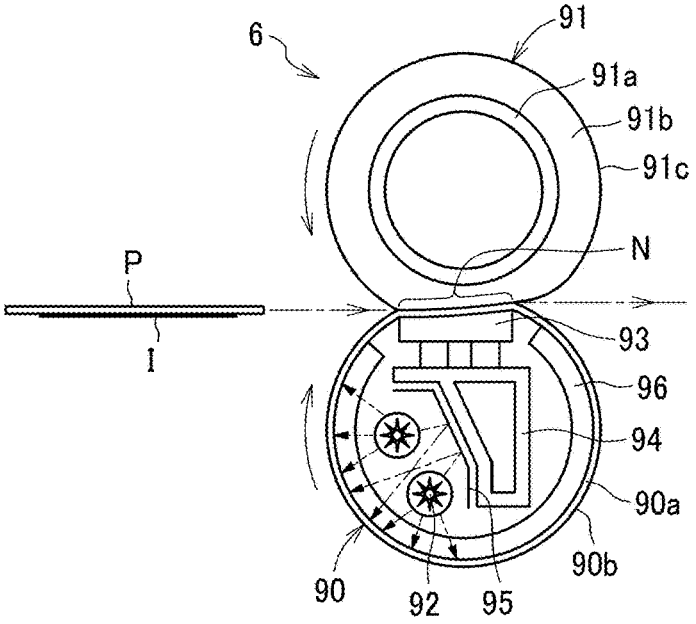
FIG. 21 is a cross-sectional view of a dryer incorporated in the image forming apparatus depicted in FIG. 20.

Referring to FIG. 21, a description is provided of one example of a construction of the dryer 6.

As illustrated in FIG. 21, the dryer 6 includes a heating belt 90, a pressure roller 91, heaters 92, a nip formation pad 93, a stay 94, a reflector 95, and belt holders 96.

The heating belt 90 is an endless belt or film serving as a heating rotator heated by the heaters 92. The heating belt 90 includes a base layer 90*a* and a release layer 90*b*. The base layer 90*a* is an endless layer having flexibility. The release layer 90*b* is mounted on an outer circumferential surface of the base layer 90*a*.

The pressure roller 91 is an elastic roller serving as a pressure rotator pressed against the heating belt 90. The pressure roller 91 includes a base layer 91*a*, an elastic layer 91*b*, and a release layer 91*c*. The base layer 91*a* (e.g., a core metal) is tubular or cylindrical. The elastic layer 91*b* is mounted on an outer circumferential surface of the base layer 91*a*. The release layer 91*c* is mounted on an outer circumferential surface of the elastic layer 91*b*.

The heater 92 is a halogen heater serving as a heat source that heats the heating belt 90. Alternatively, instead of the halogen heater, a heater of various types, for example, a heater that radiates heat, such as a carbon heater and a ceramic heater, or a heater that employs an electromagnetic induction heating system, may be used as the heat source.

The nip formation pad 93 is disposed within a loop formed by the heating belt 90. The nip formation pad 93 and the pressure roller 91 sandwich the heating belt 90 and define a nip N between the pressure roller 91 and the heating belt 90. The nip formation pad 93 and the pressure roller 91 are biased and approached each other relatively. Accordingly, the nip formation pad 93 and the pressure roller 91 are pressed against each other via the heating belt 90, forming the nip N between the pressure roller 91 and the heating belt 90.

The stay 94 serves as a support that supports the nip formation pad 93, preventing the nip formation pad 93 from being bent by pressure from the pressure roller 91, The stay 94 contacts an opposite face of the nip formation pad 93, which is opposite a pressure roller side face of the nip formation pad 93, which is disposed opposite the pressure roller 91. Thus, the stay 94 supports the nip formation pad 93.

The reflector 95 reflects light (e.g., infrared light) emitted from the heaters 92 or heat radiated from the heaters 92 toward the heating belt 90. Since the reflector 95 is disposed within the loop formed by the heating belt 90, the reflector 95 reflects light emitted from the heaters 92 to an inner circumferential surface of the heating belt 90.

The belt holders 96 are disposed at both lateral ends of the heating belt 90 in a longitudinal direction thereof, respectively, thus serving as a holder pair that supports the heating belt 90. Each of the belt holders 96 is C-shaped or cylindrical. The belt holders 96 are inserted into the loop formed by the heating belt 90 at both lateral ends of the heating belt 90 in the longitudinal direction thereof, respectively. Thus, the belt holders 96 rotatably support the heating belt 90. While the heating belt 90 rests and does not rotate, the belt holders 96 basically support the heating belt 90 in a state in which the heating belt 90 is not applied with tension in a circumferential direction thereof by a free belt system.

As illustrated in FIG. 21, as a driver disposed inside a body of the image forming apparatus 100I drives and rotates the pressure roller 91, a driving force is transmitted from the pressure roller 91 to the heating belt 90 through the nip N, rotating the heating belt 90 in accordance with rotation of the pressure roller 91. As each of the heaters 92 generates heat, each of the heaters 92 disposed opposite the inner circumferential surface of the heating belt 90 heats the heating belt 90. In a state in which the temperature of the heating belt 90 reaches a predetermined temperature (e.g., a drying temperature), as the sheet P bearing an image enters the nip N formed between the heating belt 90 and the pressure roller 91, the image bearing face (e.g., a face adhered with ink I) of the sheet P is brought into contact with the heating belt 90 and heated by the heating belt 90, thus facilitating drying of the ink T on the sheet P. Thereafter, the heating belt 90 and the pressure roller 91, which rotate, eject the sheet P from the dryer 6 and convey the sheet P to the sheet ejection portion 7 or the post-processing apparatus 200 depicted in FIG. 1.

As described above, as the heaters 92 heat the heating belt 90 in the dryer 6, a part of heat dissipates from the heating belt 90 into circumambient air and blows as warm air. If the warm air is left unused, the warm air is discharged to an outside of the image forming apparatus 100I and is not used effectively. To address this circumstance, according to this embodiment, the warm air that blows in a periphery of the dryer 6 is used to warm the sheet P before an image is formed on the sheet P.

For example, as illustrated in FIG. 20, a suction fan 59 sucks the warm air generated in the periphery of the dryer 6 through inlets 61*a* of a first duct 61. The first duct 61 extends throughout an entire span of the heating belt 90 of the dryer 6 in the longitudinal direction of the heating belt 90 or the width direction of the sheet P, The dust duct 61 includes the plurality of inlets 61*a* that is disposed opposite the heating belt 90. The first duct 61 guides the warm air sucked through the inlets 61*a* to a second duct 62 disposed in the rear chamber 10. A fan 64 guides the warm air to a third duct 63. The third duct 63 is disposed opposite a conveyance path through which the sheet P not formed with an image yet is conveyed. The third duct 63 sends the warm air to the sheet P not formed with the image yet through a plurality of vents 63*a* (e.g., outlets) of the third duct 63.

As described above, according to this embodiment, the plurality of ducts serving as air channel formers, that is, the first duct 61, the second duct 62, and the third duct 63, sends the warm air in the periphery of the dryer 6 to the sheet P. Thus, heat generated by the heaters 92 of the dryer 6 is used effectively as heat that warms the sheet P before the image is formed on the sheet P. Hence, the image forming apparatus 100I according to this embodiment reduces power consumption compared to a configuration in which both the dryer 6 and the ventilation device 50I incorporate heaters, respectively. For example, the dryer 6 and the ventilation device 50I share the heaters 92 as common heaters, reducing power consumption and manufacturing costs.

Figure 22:
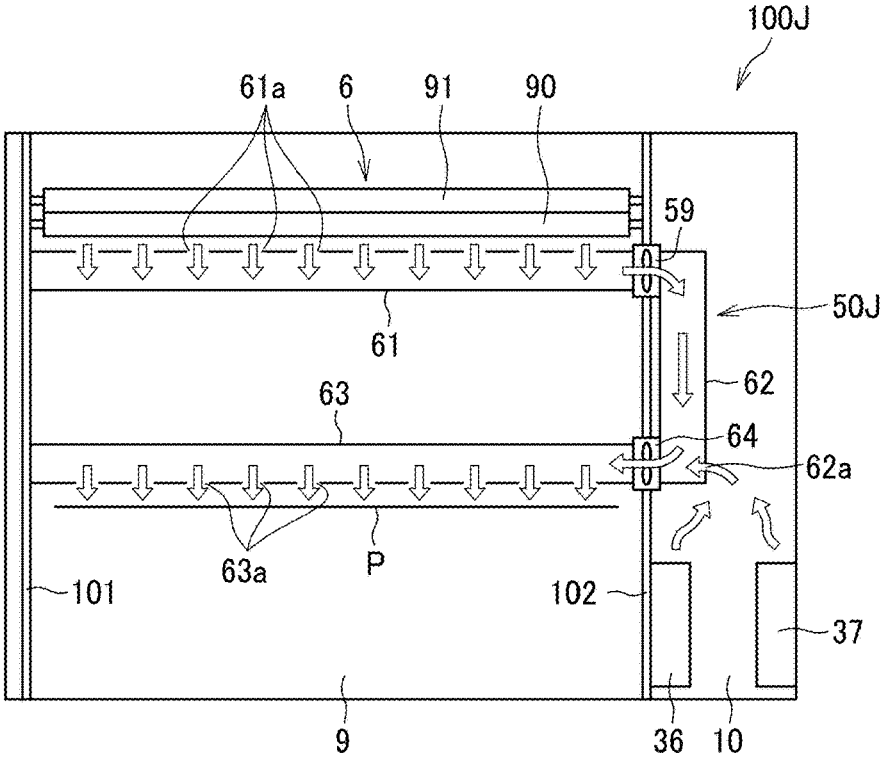
FIG. 22 is a cross-sectional view of an image forming apparatus according to a twelfth embodiment of the present disclosure.

FIG. 22 illustrates an image forming apparatus 100I according to a twelfth embodiment of the present disclosure. The image forming apparatus 100J, also serving as a liquid discharge apparatus, includes a ventilation device 50J. The ventilation device 50J includes an inlet 62*a* that sucks heat generated by the heat radiators such as the driver 36 and the power supply 37 disposed in the rear chamber 10. Thus, the ventilation device 50J uses the heat generated by the heat radiators in addition to heat generated by the dryer 6, thus reducing power consumption further.

Figure 23:
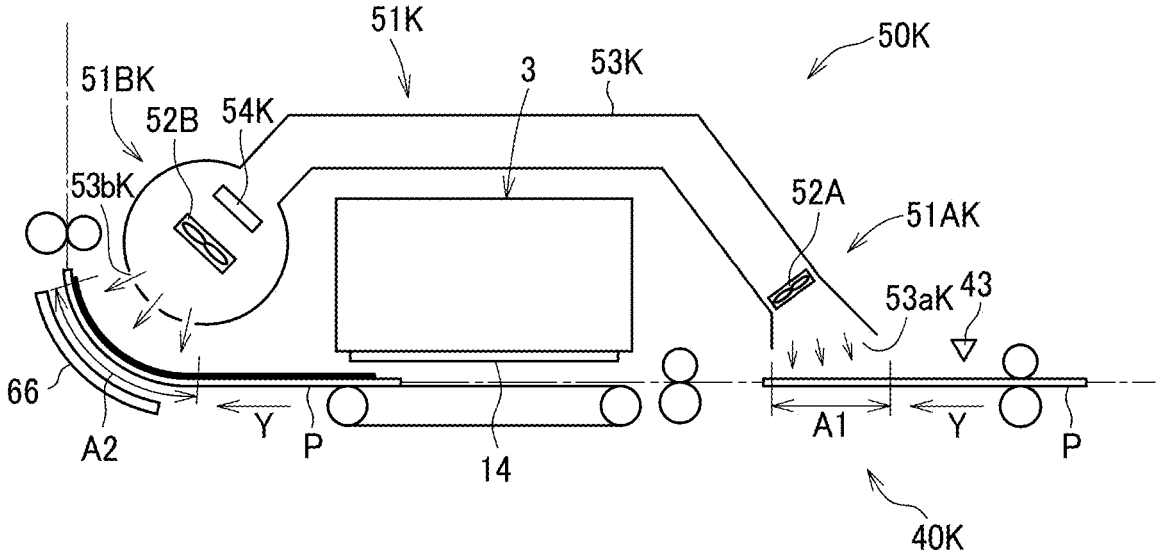
FIG. 23 is a cross-sectional view of a conveyance device according to a thirteenth embodiment of the present disclosure, that is installable in the image forming apparatus depicted in FIG. 1, illustrating a duct incorporated in the conveyance device.

FIG. 23 is a diagram of a conveyance device 40K according to a thirteenth embodiment of the present disclosure, illustrating a construction of the conveyance device 40K.

As illustrated in FIG. 23, the conveyance device 40K according to the thirteenth embodiment of the present disclosure includes a ventilation device 50K that sends air to the sheet P after an image is formed on the sheet P, in addition to sending air before the image is formed on the sheet P, unlike the embodiments described above. For example, as illustrated in FIG. 23, the ventilation device 50K includes a ventilator 51K including an upstream ventilating portion 51AK and a downstream ventilating portion 51BK. The upstream ventilating portion 51AK is disposed upstream from the liquid discharge heads 14 in the sheet conveyance direction Y and sends air to the sheet P. The downstream ventilating portion 51BK is disposed downstream from the liquid discharge heads 14 in the sheet conveyance direction Y and sends air to the sheet P.

The ventilator 51K according to this embodiment includes a single duct 53K serving as an air channel former and two fans, that is, a first fan 52A and a second fan 52B, serving as airflow generators, respectively. The duct 53K extends continuously from the upstream ventilating portion 51AK to the downstream ventilating portion 51BK. The upstream ventilating portion 51AK and the downstream ventilating portion 51BK include vents 53*a*K and 53*b*K (e.g., outlets), respectively. One of the two fans, that is, the first fan 52A, is disposed in the upstream ventilating portion 51AK inside the duct 53K. The first fan 52A generates an airflow toward the vent 53*a*K of the upstream ventilating portion 51AK. Conversely, another one of the two fans, that is, the second fan 52B, is disposed in the downstream ventilating portion 51BK inside the duct 53K. The second fan 52B generates an airflow toward the vent 53*b*K of the downstream ventilating portion 51BK. A heater 54K serving as a heat source is disposed in the downstream ventilating portion 51BK inside the duct 53K.

In the conveyance device 40K according to this embodiment having the construction described above, the heater 54K generates heat that warms air into warm air. The first fan 52A blows the warm air out through the vent 53*a*K of the upstream ventilating portion 51AK against the sheet P before an image is formed on the sheet P. Thereafter, the image forming device 3 forms the image on the sheet P, When the sheet P reaches the downstream ventilating portion 51BK, the second fan 52B blows the warm air out through the vent 53*b*K of the downstream ventilating portion 51BK against the sheet P after the image is formed on the sheet P.

As described above, according to this embodiment, the warm air blows against the sheet P before and after the image is formed on the sheet P, drying ink on the sheet P more effectively. According to this embodiment, a heating portion (e.g., the downstream ventilating portion 51BK) disposed downstream from the liquid discharge heads 14 in the sheet conveyance direction Y heats the sheet P. The duct 53K guides the warm air generated inside the downstream ventilating portion 51BK to the upstream ventilating portion 51AK. Thus, the downstream ventilating portion 51BK and the upstream ventilating portion 51AK share heat generated by the heater 54K. Accordingly, the conveyance device 40K does not incorporate a plurality of heaters, attaining reduction of manufacturing costs and downsizing of the conveyance device 40K.

Figure 24:
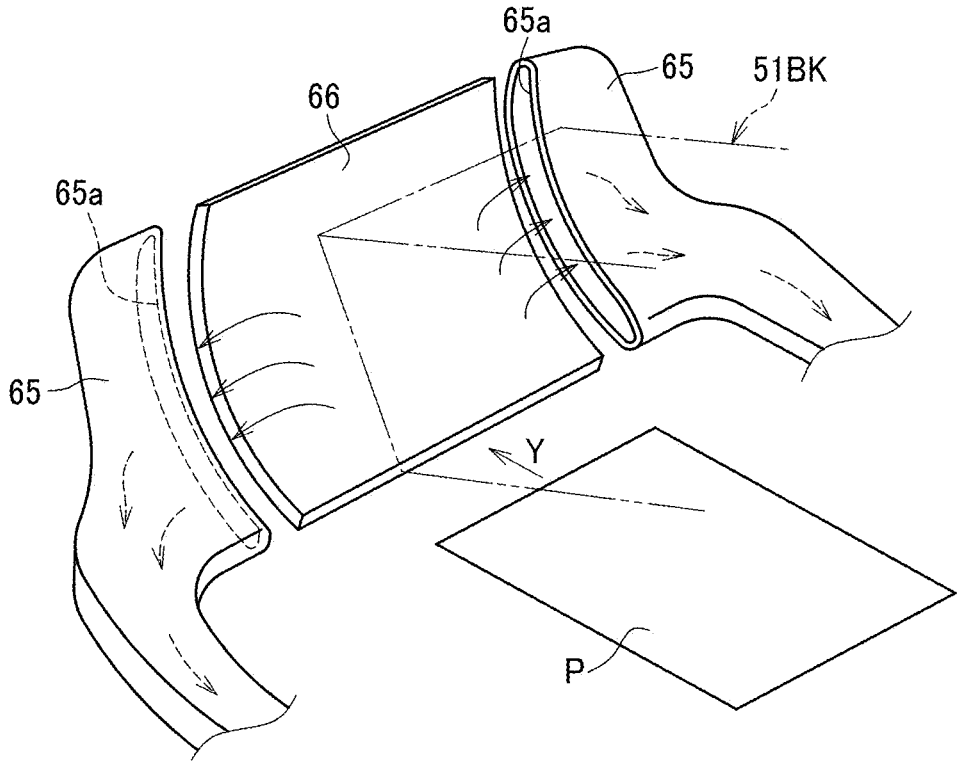
FIG. 24 is a perspective view of a duct as a modification example of the duct depicted in FIG. 23.

As illustrated in FIG. 24, the conveyance device 40K may further include ducts 65 that collect the warm air sent from the downstream ventilating portion 51BK. The ducts 65 sandwich a guide 66 in the width direction of the sheet P. The guide 66 defines a conveyance path through which the sheet P is conveyed. Inlets 65*a* suck and collect the warm air blown out toward the guide 66 or the sheet P. The ducts 65 are coupled with the upstream ventilating portion 51AK and guide the collected warm air to the upstream ventilating portion 51AK. Thus, the ducts 65 guide the warm air sent from the downstream ventilating portion 51BK to the upstream ventilating portion 51AK.

According to this embodiment also, as illustrated in FIG. 23, while the leading end of the sheet P passes through blow regions A1 and A2 defined by the upstream ventilating portion 51AK and the downstream ventilating portion 51BK, respectively, like in the embodiments described above, the controller 60 controls the ventilation device 50K to interrupt sending air from each of the upstream ventilating portion 51AK and the downstream ventilating portion 51BK or decrease the air capacity of each of the upstream ventilating portion 51AK and the downstream ventilating portion 51BK. Accordingly, the conveyance device 40K prevents air from turning up or fluttering the sheet P, improving conveyance of the sheet P.

The above describes the embodiments of the present disclosure. However, the technology of the present disclosure is not limited to the embodiments described above and is modified within the scope of the present disclosure.

An image forming apparatus applied with any one of the embodiments of the present disclosure is not limited to the image forming apparatus 100 depicted in FIG. 1. For example, each of the embodiments of the present disclosure is also applicable to image forming apparatuses 100L and 100M illustrated in FIGS. 25 and 26, respectively.

The following describes constructions of the image forming apparatuses 100L and 100M to which any one of the embodiments of the present disclosure is applicable. The constructions of the image forming apparatuses 100L and 100M, respectively, are described mainly for a part that is not shared by the image forming apparatus 100 depicted in FIG. 1. A description of other part that is shared by the image forming apparatus 100 and therefore is described above is omitted.

Figure 25:
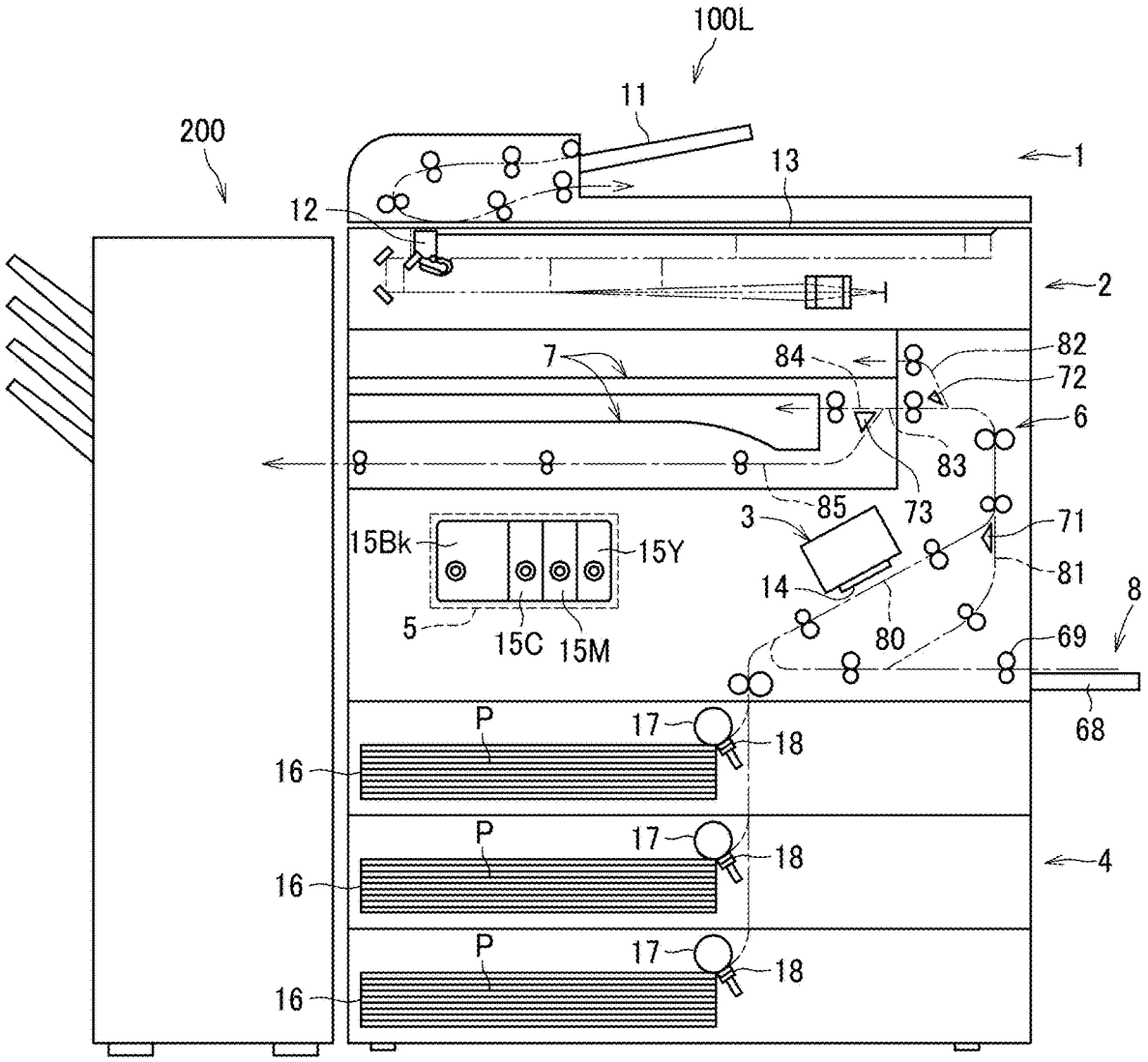
FIG. 25 is a schematic cross-sectional view of an image forming apparatus as a first variation of the image forming apparatus depicted in FIG. 1.

As illustrated in FIG. 25, the image forming apparatus 100L also serving as a liquid discharge apparatus, like the image forming apparatus 100 depicted in FIG. 1 and described above in the embodiments, includes the original conveyance device 1, the scanner 2, the image forming device 3, the sheet supply 4, the cartridge holder 5, the dryer 6, and the sheet ejection portion 7. The image firming apparatus 100L further includes a bypass sheet supply 8, Unlike the image forming device 3 depicted in FIG. 1, the image forming device 3 depicted in FIG. 25 is disposed opposite a conveyance path 80 inclined with respect to a horizontal direction in FIG. 25 such that a sheet P is conveyed obliquely with respect to the horizontal direction through the conveyance path 80.

The bypass sheet supply 8 includes a bypass tray 68 and a feed roller 69. The bypass tray 68 serves as a table where a sheet P is placed. The feed roller 69 serves as a feeder that feeds the sheet P from the bypass tray 68. The bypass tray 68 is attached to a body of the image forming apparatus 100L. As the bypass tray 68 pivots, the bypass tray 68 is opened and closed with respect to the body of the image forming apparatus 100L. As a user opens the bypass tray 68 as illustrated in FIG. 25, the user places the sheet P on the bypass tray 68 so that the feed roller 69 feeds the sheet P.

When the image forming apparatus 100L depicted in FIG. 25 receives an instruction to start a print job, the sheet supply 4 or the bypass sheet supply 8 supplies a sheet P that is conveyed to the image forming device 3. When the sheet P reaches the image forming device 3, the liquid discharge heads 14 discharge ink onto the sheet P, forming an image on the sheet P.

If the print job instructs duplex printing, after the sheet P passes the image forming device 3, the sheet P is conveyed in an opposite direction. A first path switch 71 guides the sheet P to a reverse conveyance path 81. The sheet P passes through the reverse conveyance path 81 and is conveyed to the image forming device 3 again in a state in which the sheet P is reversed. The image forming device 3 forms an image on the back side of the sheet P.

The sheet P bearing the image on one side (e.g., the front side) or both sides (e.g., the front side and the back side) thereof is conveyed to the dryer 6 that dries ink on the sheet P. A second path switch 72 selectively guides the sheet P that has passed the dryer 6 to a conveyance path 82 directed to an upper stage of the sheet ejection portion 7 or a conveyance path 83 directed to a lower stage of the sheet ejection portion 7. If the sheet P is guided to the conveyance path 82 directed to the upper stage of the sheet ejection portion 7, the sheet P is ejected onto the upper stage of the sheet ejection portion 7. Conversely, if the sheet P is guided to the conveyance path 83 directed to the lower stage of the sheet ejection portion 7, a third path switch 73 selectively guides the sheet P to a conveyance path 84 directed to the lower stage of the sheet ejection portion 7 or a conveyance path 85 directed to the post-processing apparatus 200.

If the sheet P is guided to the conveyance path 84 directed to the lower stage of the sheet ejection portion 7, the sheet P is ejected onto the lower stage of the sheet ejection portion 7. Conversely, if the sheet P is guided to the conveyance path 85 directed to the post-processing apparatus 200, the sheet P is conveyed to the post-processing apparatus 200 where the sheet P is treated with post-processing.

Figure 26:
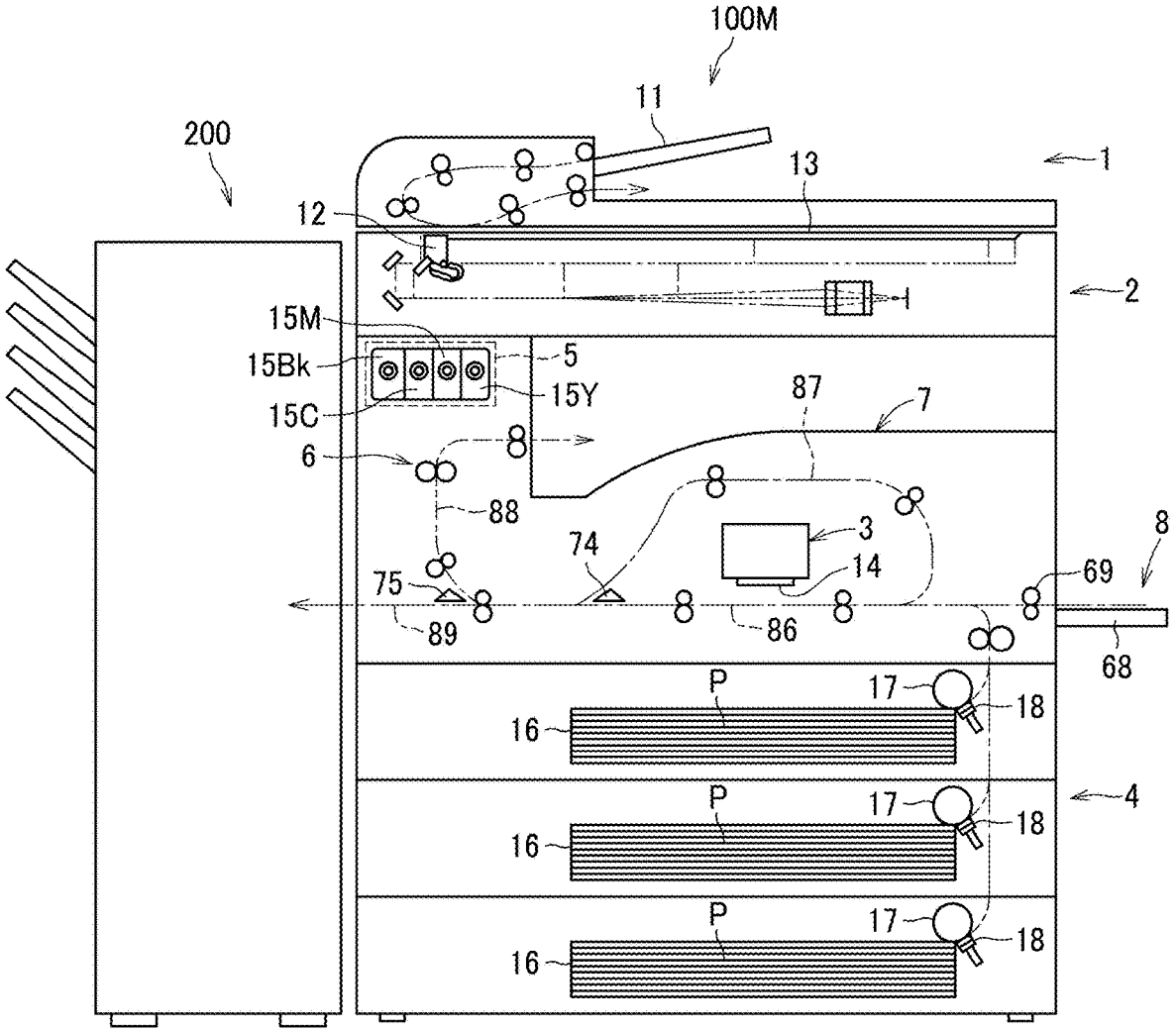
FIG. 26 is a schematic cross-sectional view of an image forming apparatus as a second variation of the image forming apparatus depicted in FIG. 1.

Like the image forming apparatus 100L depicted in FIG. 25, the image forming apparatus 100I illustrated in FIG. 26, also serving as a liquid discharge apparatus, includes the original conveyance device 1, the scanner 2, the image forming device 3, the sheet supply 4, the cartridge holder 5, the dryer 6, the sheet ejection portion 7, and the bypass sheet supply 8. Like the image forming device 3 depicted in FIG. 1, the image forming device 3 depicted in FIG. 26 is disposed opposite a conveyance path 86 extended in a horizontal direction in FIG. 26 such that a sheet P is conveyed in the horizontal direction through the conveyance path 86.

When the image forming apparatus 100M depicted in FIG. 26 receives an instruction to start a print job, the sheet supply 4 or the bypass sheet supply 8 supplies a sheet P that is conveyed to the image forming device 3. When the sheet P reaches the image forming device 3, the liquid discharge heads 14 discharge ink onto the sheet P, forming an image on the sheet P.

If the print job instructs duplex printing, after the sheet P passes the image forming device 3, the sheet P is conveyed in an opposite direction. A first path switch 74 guides the sheet P to a reverse conveyance path 87. The sheet P passes through the reverse conveyance path 87 and is conveyed to the image forming device 3 again in a state in which the sheet P is reversed. The image forming device 3 forms an image on the back side of the sheet P.

A second path switch 75 selectively guides the sheet P bearing the image on one side (e.g., the front side) or both sides (e.g., the front side and the back side) thereof to a conveyance path 88 directed to the dryer 6 or a conveyance path 89 directed to the post-processing apparatus 200. If the sheet P is guided to the conveyance path 88 directed to the dryer 6, the dryer 6 dries ink on the sheet P. The sheet P that has passed the dryer 6 is ejected onto the sheet ejection portion 7. Conversely, if the sheet P is guided to the conveyance path 89 directed to the post-processing apparatus 200, the sheet P is conveyed to the post-processing apparatus 200 where the sheet P is treated with post-processing.

Each of the image forming apparatus 100L depicted in FIG. 25 and the image forming apparatus 100I4 depicted in FIG. 26 is also applied with any one of the embodiments of the present disclosure, attaining advantages similar to the advantages described above. For example, a conveyance device (e.g., the conveyance devices 40, 40A, 40AM, 40B, 40C, 40D, 40E, 40F, and 40G) installed in each of the image forming apparatuses 100L and 100M includes a ventilation device (e.g., the ventilation devices 50, 50A, 50G, 50H, 50I, 50J, and 50K) that sends air to the sheet P. When the leading end of the sheet P passes through a blow region (e.g., the blow regions A, A1, and A2), the controller 60 controls the ventilation device to interrupt sending air or decrease the air capacity, preventing the air sent from the ventilation device from turning up or fluttering the sheet P.

Figure 27:
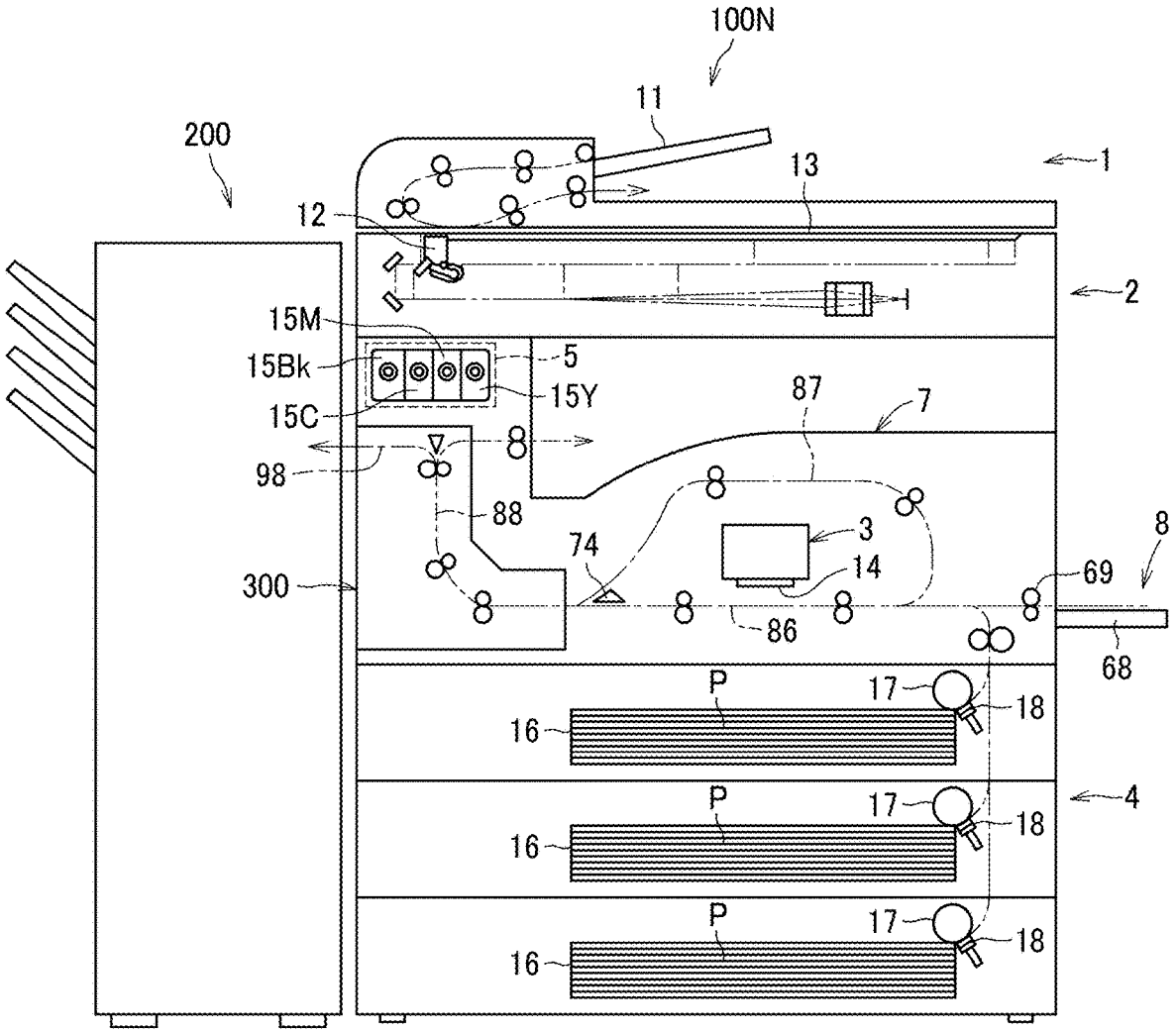
FIG. 27 is a schematic cross-sectional view of an image forming apparatus as a third variation of the image forming apparatus depicted in FIG. 1, illustrating a conveyance unit incorporated therein.

The conveyance device according to any one of the embodiments of the present disclosure is installed in a body of an image forming apparatus (e.g., the image forming apparatuses 100, 100H, 100I 100J, 100L, and 100M). Alternatively, the conveyance device according to any one of the embodiments of the present disclosure may be applied to a conveyance device (e.g., a conveyance unit) that is removably attached to the body of the image forming apparatus. FIG. 27 illustrates an image forming apparatus 100N, also serving as a liquid discharge apparatus, that includes a conveyance unit 300 to which any one of the embodiments of the present disclosure is applicable.

As illustrated in FIG. 27, the conveyance unit 300 includes conveyance paths 88 and 98 that convey a sheet P bearing an image to the post-processing apparatus 200 (e.g., a sheet aligner). The conveyance unit 300 is removably installed in a body of the image forming apparatus 100N, In the conveyance unit 300 also, if the conveyance unit 300 includes a ventilation device (e.g., the ventilation devices 50, 50A, 50G, 50H, 50I, 50J, and 50K) that sends air to the sheet P, like in the embodiments described above, when the leading end of the sheet P passes through a blow region (e.g., the blow regions A, A1, and A2), the controller 60 controls the ventilation device to interrupt sending air from the ventilation device or decrease the air capacity, preventing the air sent from the ventilation device from turning up or fluttering the sheet P.

Figure 28:
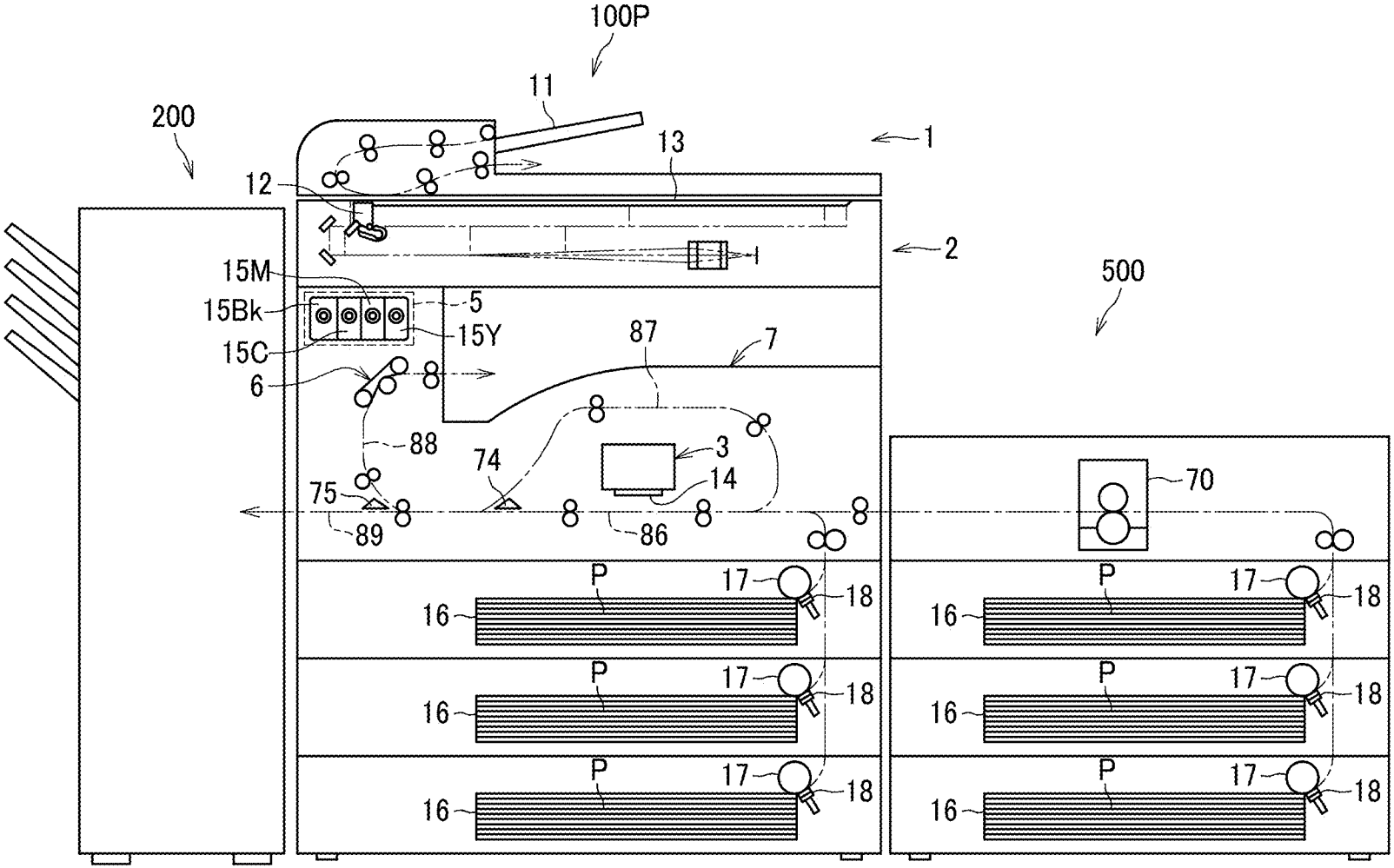
FIG. 28 is a schematic cross-sectional view of a liquid discharge apparatus in which the dryer depicted in FIG. 21 is installable.

The conveyance device according to any one of the embodiments of the present disclosure is installed in an image forming apparatus (e.g., the image forming apparatuses 100, 100H, 100I, 100J, 100L, 100M, and 100N), also serving as a liquid discharge apparatus, that forms an image on a sheet. Alternatively, the conveyance device according to any one of the embodiments of the present disclosure may be applied to a liquid discharge apparatus that discharges process liquid or the like not forming an image on a sheet. FIG. 28 illustrates a liquid discharge apparatus 500 to which any one of the embodiments of the present disclosure is applicable.

As illustrated in FIG. 28, the liquid discharge apparatus 500 includes a process liquid discharger 70 serving as a liquid discharger that discharges process liquid that improves a surface of a sheet P before an image is formed on the sheet P. After the process liquid discharger 70 discharges the process liquid onto the sheet P, the sheet P is conveyed to an image forming apparatus 100P. After the image forming device 3 of the image forming apparatus 100P, also serving as a liquid discharge apparatus, discharges ink onto the sheet P, the sheet P is conveyed to the dryer 6 that dries the ink on the sheet P.

In a conveyance device (e.g., the conveyance devices 40, 40A, 40AM, 40B, 40C, 40D, 40E, 40F, and 40G) installed in the liquid discharge apparatus 500 also, if the conveyance device includes a ventilation device (e.g., the ventilation devices 50, 50A, 50G, 50H, 50I, 50J, and 50K) that sends air to the sheet P, like in the embodiments described above, when the leading end of the sheet P passes through a blow region (e.g., the blow regions A, A1, and A2), the controller 60 preferably controls the ventilation device to interrupt sending air from the ventilation device or decrease the air capacity, thus preventing the air from turning up or fluttering the sheet P.

Figure 29:
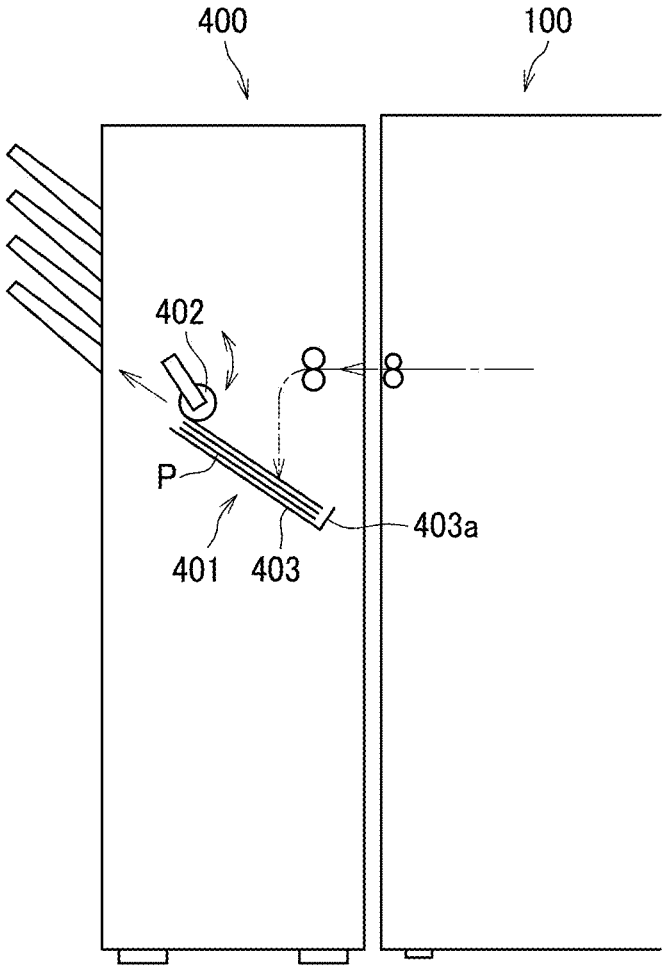
FIG. 29 is a cross-sectional view of a post-processing apparatus in which the conveyance device depicted in FIG. 2 is installable.

Each of the embodiments of the present disclosure is also applicable to a post-processing apparatus that performs post-processing on a sheet bearing an image. FIG. 29 illustrates a post-processing apparatus 400 (e.g., a finisher) as an example of the post-processing apparatus to which any one of the embodiments of the present disclosure is applicable.

As illustrated in FIG. 29, the post-processing apparatus 400 includes a post-processing device 401 that performs post-processing such as stapling and punching on a sheet P. When the sheet P is conveyed from the image forming apparatus 100 to the post-processing apparatus 400 depicted in FIG. 29, a conveyance roller pair and the like convey the sheet P. Thereafter, the sheet P is placed on a mounting tray 403 of the post-processing device 401. If the post-processing apparatus 400 employs a face-up manner system in which the sheets P are placed on the mounting tray 403 such that the image bearing face of each of the sheets P faces up, the sheets P are formed with images in an image formation order in which an image is formed on a last page of the sheets P first so that the last page of the sheets P is placed on the mounting tray 403 first. A conveyance roller 402 of the post-processing device 401 rotates forward to convey the sheet P placed on the mounting tray 403 backward. Accordingly, the trailing end of the sheet P strikes a trailing end restrictor 403*a* of the mounting tray 403. Thus, the trailing end restrictor 403*a* aligns the trailing ends of the sheets P. In order to prevent the conveyance roller 402 from disturbing ejection of the sheets P onto the mounting tray 403, the conveyance roller 402 moves from a contact position where the conveyance roller 402 contacts the sheet P to a retracted position where the conveyance roller 402 does not contact the sheet P. In a state in which the trailing ends of the sheets P are aligned, the post-processing device 401 performs post-processing such as stapling and punching on the sheets P. Thereafter, the conveyance roller 402 rotates backward to eject the sheets P placed on the mounting tray 403 to an outside of the post-processing apparatus 400.

In a conveyance device (e.g., the conveyance devices 40, 40A, 40AM, 40B, 40C, 40D, 40E, 40F, and 40G) installed in the post-processing apparatus 400 also, if the conveyance device includes a ventilation device (e.g., the ventilation devices 50, 50A, 50G, 50H, 50I, 50J, and 50K) that sends air to the sheet P, like in the embodiments described above, when the leading end of the sheet P passes through a blow region (e.g., the blow regions A, A1, and A2), the controller 60 controls the ventilation device to interrupt sending air from the ventilation device or decrease the air capacity, preventing the air sent from the ventilation device from turning up or fluttering the sheet P.

According to the embodiments of the present disclosure, the sheets P include, in addition to plain paper, thick paper, thin paper, coated paper, a label sheet, and an envelope. The sheet P conveyed by the conveyance device according to any one of the embodiments of the present disclosure is not limited to a sheet made of paper. Alternatively, the sheet P may be a sheet made of resin, such as an overhead projector (OHP) transparency.

A description is provided of advantages of a conveyance device (e.g., the conveyance devices 40, 40A, 40AM, 40B, 40C, 40D, 40E, 40F, and 40G).

As illustrated in FIG. 2, the conveyance device includes a conveyor (e.g., the conveyance roller 42 and the conveyance belt 44), a ventilator (e.g., the ventilators 51, 51A, and 51K), and a controller (e.g., the controller 60). The conveyor conveys a sheet (e.g., the sheet P). The ventilator sends air to the sheet conveyed by the conveyor in a predetermined region (e.g., the blow regions A, A1, and A2). At a time when a leading end of the sheet in a sheet conveyance direction (e.g., the sheet conveyance direction Y) is in the predetermined region and at a time when the leading end of the sheet in the sheet conveyance direction is past the predetermined region, the controller controls the ventilator to change an air capacity of the air sent from the ventilator.

Accordingly, the conveyance device prevents the air sent from the ventilator from turning up or fluttering the sheet, improving conveyance of the sheet.

According to the embodiments described above, the image forming apparatus 100 is a copier. Alternatively, the image forming apparatus 100 may be a printer, a facsimile machine, a multifunction peripheral (MFP) having at least two of printing, copying, facsimile, scanning, and plotter functions, an inkjet recording apparatus, or the like.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A conveyance device comprising:

a conveyor configured to convey a sheet;

a ventilator configured to send air to the sheet conveyed by the conveyor in a predetermined region;

a controller configured to control the ventilator to change an air capacity of the air at a time when a leading end of the sheet in a sheet conveyance direction is in the predetermined region and at a time when the leading end of the sheet is past the predetermined region;

a heater configured to heat the air, wherein the ventilator is configured to send the heated air to the sheet; and a thermal insulator disposed at at least one of an upstream position disposed upstream from the ventilator in the sheet conveyance direction and a downstream position disposed downstream from the ventilator in the sheet conveyance direction.

2. The conveyance device according to claim 1, wherein the controller is configured to control the ventilator to interrupt sending the air to the sheet when the leading end of the sheet is in the predetermined region.

3. The conveyance device according to claim 1, further comprising:

a sheet sensor configured to detect the sheet; and a valve disposed inside the ventilator, wherein the ventilator includes a fan, and wherein the controller is configured to control the valve and the fan based on a detection signal sent from the sheet sensor.

4. A liquid discharge apparatus comprising:

a liquid discharger configured to discharge liquid onto a sheet; and a conveyance device including:

a conveyor configured to convey the sheet;

a ventilator configured to send air to the sheet conveyed by the conveyor in a predetermined region;

a controller configured to control the ventilator to change an air capacity of the air at a time when a leading end of the sheet in a sheet conveyance direction is in the predetermined region and at a time when the leading end of the sheet is past the predetermined region;

a heater configured to heat the air, wherein the ventilator is configured to send the heated air to the sheet; and a thermal insulator disposed at at least one of an upstream position disposed upstream from the ventilator in the sheet conveyance direction and a downstream position disposed downstream from the ventilator in the sheet conveyance direction.

5. The liquid discharge apparatus according to claim 4, wherein the ventilator is disposed upstream from the liquid discharger in the sheet conveyance direction.

6. The liquid discharge apparatus according to claim 5, wherein the ventilator includes a vent extended diagonally with respect to the sheet and configured to send the air upstream in the sheet conveyance direction.

7. The liquid discharge apparatus according to claim 5, further comprising a wall interposed between the ventilator and the liquid discharger.

8. The liquid discharge apparatus according to claim 7, further comprising another conveyor configured to convey the sheet.

9. The liquid discharge apparatus according to claim 8, wherein the wall is configured to contact said another conveyor.

10. The liquid discharge apparatus according to claim 8, further comprising a rotator interposed between the wall and said another conveyor, wherein said another conveyor is configured to rotate so as to convey the sheet.

11. The liquid discharge apparatus according to claim 8, wherein said another conveyor has a conveyance face configured to contact the wall, and wherein the wall includes a slope configured to define a gap between the wall and the conveyance face of said another conveyor, the gap configured to increase from a contact position where the wall contacts the conveyance face of said another conveyor to an upstream position on the wall, the upstream position disposed upstream from the contact position in the sheet conveyance direction.

12. The liquid discharge apparatus according to claim 7, further comprising a guide configured to guide the sheet and contact the wall.

13. The liquid discharge apparatus according to claim 12, wherein the guide has a guide face configured to contact the wall, and wherein the wall includes a slope configured to define a gap between the wall and the guide face of the guide, the gap configured to increase from a contact position where the wall contacts the guide face of the guide to an upstream position on the wall, the upstream position disposed upstream from the contact position in the sheet conveyance direction.

14. The liquid discharge apparatus according to claim 4, wherein the ventilator includes:

an upstream ventilating portion disposed upstream from the liquid discharger in the sheet conveyance direction, the upstream ventilating portion configured to send the heated air to the sheet.

15. The liquid discharge apparatus according to claim 14, wherein the ventilator further includes a downstream ventilating portion disposed downstream from the liquid discharger in the sheet conveyance direction, the downstream ventilating portion configured to send the heated air to the sheet.

16. The liquid discharge apparatus according to claim 15, wherein the heater is disposed in the downstream ventilating portion, and wherein the ventilator further includes an air channel former configured to guide the heated air from the downstream ventilating portion to the upstream ventilating portion.

17. The liquid discharge apparatus according to claim 4, wherein the liquid discharger is configured to discharge the liquid onto the sheet to form an image on the sheet.

18. A post-processing apparatus comprising:

a conveyance device including:

a conveyor configured to convey a sheet;

a ventilator configured to send air to the sheet conveyed by the conveyor in a predetermined region;

a controller configured to control the ventilator to change an air capacity of the air at a time when a leading end of the sheet in a sheet conveyance direction is in the predetermined region and at a time when the leading end of the sheet is past the predetermined region;

a heater configured to heat the air, wherein the ventilator is configured to send the heated air to the sheet; and a thermal insulator disposed at at least one of an upstream position disposed upstream from the ventilator in the sheet conveyance direction and a downstream position disposed downstream from the ventilator in the sheet conveyance direction; and a post-processing device configured to perform post-processing on the sheet conveyed from the conveyance device.

* * * * *